US011945480B2

(12) United States Patent
Green et al.

(10) Patent No.: US 11,945,480 B2
(45) Date of Patent: Apr. 2, 2024

(54) POSITIONING AND ODOMETRY SYSTEM

(71) Applicant: Ground Transportation Systems Canada Inc., Toronto (CA)

(72) Inventors: Alon Green, Toronto (CA); James Kevin Tobin, Toronto (CA); Marco De Thomasis, Toronto (CA)

(73) Assignee: GROUND TRANSPORTATION SYSTEMS CANADA INC., Ontario (CA)

( * ) Notice: Subject to any disclaimer, the term of this patent is extended or adjusted under 35 U.S.C. 154(b) by 737 days.

(21) Appl. No.: 17/115,348

(22) Filed: Dec. 8, 2020

(65) Prior Publication Data

US 2021/0171079 A1 Jun. 10, 2021

Related U.S. Application Data

(60) Provisional application No. 62/945,654, filed on Dec. 9, 2019.

(51) Int. Cl.
*B61L 25/02* (2006.01)
*B61L 5/12* (2006.01)
(Continued)

(52) U.S. Cl.
CPC ..... *B61L 25/021* (2013.01); *B61L 5/125* (2013.01); *B61L 15/0027* (2013.01);
(Continued)

(58) Field of Classification Search
CPC .... B61L 25/025; B61L 5/125; B61L 15/0027; B61L 15/02; B61L 25/021; B61L 25/023;
(Continued)

(56) References Cited

U.S. PATENT DOCUMENTS 5,072,900 A 12/1991 Malon
5,496,003 A 3/1996 Bernard
(Continued)

FOREIGN PATENT DOCUMENTS

CN 104554350 A 4/2015
DE 10 2014 002 297 A1 3/2015
(Continued)

OTHER PUBLICATIONS

Javed et al., "BWS: Beacon-driven Wake-up Scheme for Train Localization using Wireless Sensor Networks", Jun. 14, 2014; pp. 1-7. https://ieeexplore.ieee.org/asbtract/document/6883331.
(Continued)

*Primary Examiner* — Zachary L Kuhfuss
(74) *Attorney, Agent, or Firm* — HAUPTMAN HAM, LLP

(57) ABSTRACT

A positioning and odometry system includes two or more vehicle beacons installed on an end of a vehicle and configured to communicate with one or more guideway beacons installed along a guideway. Processing circuitry is configured to communicate with the one or more vehicle beacons and perform at least one of: determine, before the processing circuitry enters a sleep state, a first vehicle position on the guideway; determine, after the processing circuitry wakes from the sleep state, a second vehicle position on the guideway; determine, after the processing circuitry wakes from the sleep state, any difference between the first vehicle position on the guideway and the second vehicle position on the guideway; determine a third vehicle position on the guideway using range measurements taken at configurable time intervals; and determine a vehicle speed where speed is measured as a change in the third vehicle position over time.

20 Claims, 16 Drawing Sheets

(51) Int. Cl.
*B61L 15/00* (2006.01)
*B61L 15/02* (2006.01)

(52) U.S. Cl.
CPC ..... *B61L 15/02* (2013.01); *B61L 25/023* (2013.01); *B61L 25/025* (2013.01); *B61L 25/026* (2013.01); *B61L 2207/00* (2013.01)

(58) Field of Classification Search
CPC .... B61L 2207/00; B61L 25/026; G01S 13/60; G01S 2013/9328
USPC ..... 246/122 R; 701/19
See application file for complete search history.

(56) References Cited

U.S. PATENT DOCUMENTS

| | | | | |
|---|---|---|---|---|
| 5,691,980 | A * | 11/1997 | Welles, II | H04W 84/20 370/316 |
| 5,839,086 | A | 11/1998 | Hirano | |
| 8,050,809 | B2 | 11/2011 | Geiger et al. | |
| 10,377,398 | B2 | 8/2019 | Hamada et al. | |
| 10,435,053 | B2 | 10/2019 | Bresson et al. | |
| 11,697,443 | B2 * | 7/2023 | Bonnes | G01S 19/14 246/122 R |
| 2014/0379181 | A1 | 12/2014 | Fujimoto et al. | |
| 2015/0344048 | A1 * | 12/2015 | Kernwein | B61L 27/53 701/19 |
| 2016/0152255 | A1 * | 6/2016 | Cuthbertson | B61L 27/57 701/19 |
| 2017/0057528 | A1 * | 3/2017 | Green | B61L 25/025 |
| 2018/0312182 | A1 * | 11/2018 | Prestail | B61L 15/0027 |
| 2019/0071106 | A1 * | 3/2019 | Carlson | B61L 27/70 |
| 2019/0072981 | A1 | 3/2019 | Bresno et al. | |
| 2019/0092360 | A1 * | 3/2019 | Green | B61L 1/14 |
| 2019/0168791 | A1 | 6/2019 | Guislain et al. | |
| 2019/0263432 | A1 * | 8/2019 | Carlson | H04W 4/40 |
| 2020/0317235 | A1 * | 10/2020 | Carlson | B61L 27/20 |

FOREIGN PATENT DOCUMENTS

| | | | | |
|---|---|---|---|---|
| DE | 102015211084 | A1 | 7/2016 | |
| EP | 1591335 | A1 | 11/2005 | |
| EP | 2675690 | B1 | 6/2016 | |
| EP | 3061666 | A1 | 8/2016 | |
| JP | H09133756 | A * | 5/1997 | B61L 25/025 |
| WO | 2006/136783 | A1 | 12/2006 | |
| WO | 2015043974 | A1 | 4/2015 | |
| WO | 2016023652 | A1 | 2/2016 | |
| WO | 2019046701 | A1 | 3/2019 | |
| WO | 2019169320 | A1 | 9/2019 | |

OTHER PUBLICATIONS

International Search Report and Written Opinion issued in corresponding International Application No. PCT/IB2020/061653, dated Mar. 10, 2021, pp. 1-8, Canadian Intellectual Property Office, Quebec, Canada.

Gsa: GRAIL: GNSS Introduction in the RAIL sector, GNSS Subsystem Requirement Specification for Enhanced ETCS Applications, Jun. 26, 2007, XP093111062, 151 pages.

Extended European Search Report issued in corresponding European Application No. 20899901.1, dated Dec. 22, 2023, pp. 1-12.

* cited by examiner

| Guideways | Orientation | Δ Position |
|---|---|---|
| 310A | Positive | $\Delta \text{ Position } R_1 = (R_1^2 - w_A^2)^{1/2} - (R_1^2 - (w_A - \frac{1}{2}\omega)^2)^{1/2}$ |
| | | $\Delta \text{ Position } R_2 = (R_2^2 - (W + w_B)^2)^{1/2} - (R_2^2 - (W + w_B + \frac{1}{2}\omega)^2)^{1/2}$ |
| | | $\Delta \text{ Position } R_3 = (R_3^2 - w_A^2)^{1/2} - (R_3^2 - (w_A + \frac{1}{2}\omega)^2)^{1/2}$ |
| | | $\Delta \text{ Position } R_4 = (R_4^2 - (W + w_B)^2)^{1/2} - (R_4^2 - (W + w_B - \frac{1}{2}\omega)^2)^{1/2}$ |
| | Negative | $\Delta \text{ Position } R_1 = (R_1^2 - w_A^2)^{1/2} - (R_1^2 - (w_A + \frac{1}{2}\omega)^2)^{1/2}$ |
| | | $\Delta \text{ Position } R_2 = (R_2^2 - (W + w_B)^2)^{1/2} - (R_2^2 - (W + w_B - \frac{1}{2}\omega)^2)^{1/2}$ |
| | | $\Delta \text{ Position } R_3 = (R_3^2 - w_A^2)^{1/2} - (R_3^2 - (w_A - \frac{1}{2}\omega)^2)^{1/2}$ |
| | | $\Delta \text{ Position } R_4 = (R_4^2 - (W + w_B)^2)^{1/2} - (R_4^2 - (W + w_B + \frac{1}{2}\omega)^2)^{1/2}$ |
| 310B | Positive | $\Delta \text{ Position } R_1 = (R_1^2 - (W + w_A)^2)^{1/2} - (R_1^2 - (W + w_A - \frac{1}{2}\omega)^2)^{1/2}$ |
| | | $\Delta \text{ Position } R_2 = (R_2^2 - w_B^2)^{1/2} - (R_2^2 - (w_B + \frac{1}{2}\omega)^2)^{1/2}$ |
| | | $\Delta \text{ Position } R_3 = (R_3^2 - (W + w_A)^2)^{1/2} - (R_3^2 - (W + w_A + \frac{1}{2}\omega)^2)^{1/2}$ |
| | | $\Delta \text{ Position } R_4 = (R_4^2 - w_B^2)^{1/2} - (R_4^2 - (w_B - \frac{1}{2}\omega)^2)^{1/2}$ |
| | Negative | $\Delta \text{ Position } R_1 = (R_1^2 - (W + w_A)^2)^{1/2} - (R_1^2 - (W + w_A + \frac{1}{2}\omega)^2)^{1/2}$ |
| | | $\Delta \text{ Position } R_2 = (R_2^2 - w_B^2)^{1/2} - (R_2^2 - (w_B - \frac{1}{2}\omega)^2)^{1/2}$ |
| | | $\Delta \text{ Position } R_3 = (R_3^2 - (W + w_A)^2)^{1/2} - (R_3^2 - (W + w_A - \frac{1}{2}\omega)^2)^{1/2}$ |
| | | $\Delta \text{ Position } R_4 = (R_4^2 - w_B^2)^{1/2} - (R_4^2 - (w_B + \frac{1}{2}\omega)^2)^{1/2}$ |

FIG. 15

POSITIONING AND ODOMETRY SYSTEM

RELATED APPLICATIONS

The following application claims priority to U.S. provisional patent application No. 62/945,654 filed on Dec. 9, 2019, and is hereby incorporated by reference in its entirety.

BACKGROUND

Position and speed determination of a rail vehicle can be performed by a system that includes a checked-redundant vehicle onboard controller (VOBC) connected to a set of sensors. The sensors can consist of a radio frequency identification (RFID) tag reader, a tachometer/speed sensor, cameras, LIDAR, UWB technology, radar (radio detection and ranging) and accelerometer with RFID tags installed along a guideway. The speed and positioning functions are typically part of the VOBC.

VOBC systems can be expensive both in sensor and support equipment cost and the manpower for installing the sensors and support equipment to operate the VOBC system. A large number of sensors are difficult to install and maintain. Each of these sensors must be maintained periodically and the maintenance is an added cost. Some sensors of a VOBC system can also be affected by environmental conditions to which a vehicle is exposed on a regular basis. Other sensors require expensive off vehicle equipment be installed on the guideway.

BRIEF DESCRIPTION OF THE DRAWINGS

Aspects of the present disclosure are best understood from the following detailed description when read with the accompanying FIGS. It is noted that, in accordance with the standard practice in the industry, various features are not drawn to scale. In fact, the dimensions of the various features may be arbitrarily increased or reduced for clarity of discussion.

FIG. 15 is a table showing change in position for along tracks position, in accordance with some embodiments.

DETAILED DESCRIPTION

Figure 1:
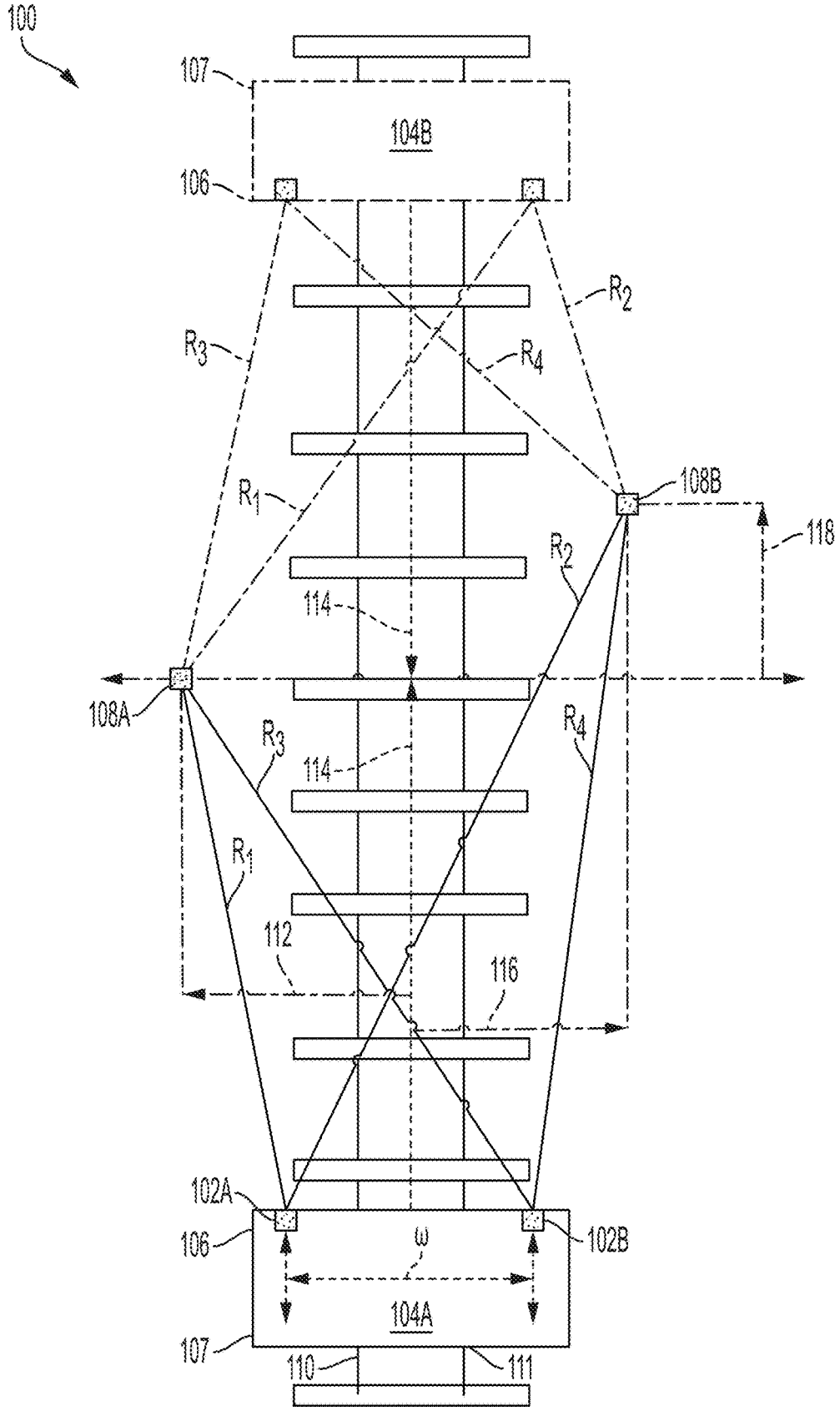
FIG. 1 is a high level diagrammatic representation of a single guideway positioning and odometry system (PAOS), in accordance with some embodiments.

The following disclosure provides many different embodiments, or examples, for implementing different features of the provided subject matter. Specific examples of components, values, operations, materials, arrangements, or the like, are described below to simplify the present disclosure. These are, of course, merely examples and are not intended to be limiting. Other components, values, operations, materials, arrangements, or the like, are contemplated. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the FIGS. The spatially relative terms are intended to encompass different orientations of the device in use or operation in addition to the orientation depicted in the FIGS. The apparatus may be otherwise oriented (rotated 90 degrees or at other orientations) and the spatially relative descriptors used herein may likewise be interpreted accordingly.

In some embodiments, a positioning and odometry system (PAOS) determines vehicle position and speed using a beacon and map system. Additionally or alternatively, the PAOS also determines a vehicle stationary state and vehicle cold motion detection (e.g., detection of vehicle motion occurring while processing circuitry is powered off) in beacon coverage areas.

In some embodiments, the PAOS includes a beacon range measurement system with vehicle beacons installed onboard the vehicle measuring the range to guideway beacons installed trackside to determine a position of the vehicle. Additionally or alternatively, frequency modulated continuous wave (FMCW) radar, from the vehicle beacons, determines the Doppler speed (e.g., radial relative speed) together with a range and angular position (azimuth) to the guideway beacons within the vehicle beacon's field of view (FOV). In some embodiments, a six degree of freedom (DOF) inertial measurement unit (IMU) measures three dimensional (3-D) acceleration and angular speed with respect to a local coordinate system. In some embodiments, positioning and odometry algorithms maintain a high safety integrity stationary state determination and cold motion detection in beacon coverage areas. Additionally or alternatively, positioning and odometry algorithms provide safety integrity level (SIL) 4 positioning and odometry functions, stationary state determination and cold motion detection on a guideway in beacon coverage areas. In some embodiments, the SIL-4 is based on international electrotechnical commission's (IEC) standard IEC 61508, or CENELEC 50126 and 50129, herein incorporated by reference in their entirety. Additionally or alternatively, SIL-4 refers to a probability of system failure per hour ranging from $10^{-8}$ to $10^{-9}$.

In some embodiments, the PAOS system (1) reduces VOBC system life cycle expense by a reduction in the number of trackside devices needed to support the PAOS; (2) is a less labor intensive installation and maintenance process for the sensors and support equipment as the sensors are vehicle body mounted and not bogie/wheel mounted; (3) is configured to determine cold motion detection and cold start localization in beacon coverage areas; and (4) is configured for continuous position determination. Additionally or alternatively, the safety integrity of the PAOS with and without beacon coverage satisfies a SIL-4. In some embodiments, areas with beacons also support a SIL-4 stationary state determination and cold motion detection.

FIG. 1 is a high level diagrammatic representation of a single guideway PAOS 100, in accordance with some embodiments. PAOS 100 includes two or more vehicle beacons 102A, 102B (hereinafter referred to as vehicle beacons 102) installed on a vehicle 104A at a vehicle first end 106 or vehicle second end 107. Vehicle beacon 102 is configured to communicate with one or more guideway beacons 108A, 108B (hereinafter referred to as guideway beacon 108) installed along a guideway 110. In some embodiments, processing circuitry (802 FIG. 8) is configured to communicate with vehicle beacons 102. Additionally or alternatively, processing circuitry (802) is configured to: determine, before processing circuitry (802) enters a sleep state, a first vehicle position on guideway 110 using range measurements between vehicle beacons 102 and guideway beacons 108; determine, after processing circuitry (802) wakes from the sleep state, a second vehicle position on guideway 110 using range measurements between vehicle beacons 102 and guideway beacons 108; determine, after processing circuitry (802) wakes from the sleep state, any difference between the first vehicle position on guideway 110 and the second vehicle position on guideway 110; determine a periodic vehicle position on guideway 110 using range measurements between vehicle 104 and guideway beacons 108 taken at predetermined time periods; and determine a vehicle speed using range measurements between a single vehicle beacon 102 and a single guideway beacon 108 where speed is measured as a change in the periodic vehicle position over time.

In some embodiments, vehicle beacon 102 and guideway beacon 108 are beacon sensors. Additionally or alternatively, the beacons are a radio beacon that marks a location and allows direction-finding equipment to find relative bearing. In some embodiments, vehicle beacon 102 and guideway beacon 108 are radio beacons that transmit a radio signal that is picked up by radio direction-finding systems to determine the direction to each beacon. In some embodiments, the vehicle beacon 102 and guideway beacon 108 are beacon sensors using ultra-wideband (UWB). UWB is a radio technology that uses a low energy level for high-bandwidth communications over a large portion of the radio spectrum, typically from 3 GHz to 10 GHz. Additionally or alternatively, UWB beacons are configured for target sensor data collection, precision locating and tracking. In some embodiments, vehicle beacon 102 and guideway beacon 108 use frequency modulated continuous-wave (FMCW) radar, a range measuring radar capable of determining distance along with speed measurement.

In some embodiments, vehicle 104A is a train having a series of connected vehicles that generally run along a railroad track (e.g., guideway or railway) to transport passengers or cargo (also known as "freight" or "goods"). In some embodiments, vehicle 104 is any vehicle that transports people or cargo. Vehicles include wagons, bicycles, motor vehicles (e.g., motorcycles, cars, trucks, and buses), watercraft (e.g., ships, boats), amphibious vehicles (e.g., screw-propelled vehicle, hovercraft), aircraft (e.g., airplanes, helicopters), spacecraft or the like.

In some embodiments, guideway 110 provides both physical support, like a road, as well as the guidance. In the case of fixed-route systems, the two are often the same in the same way that a rail line provides both support and guidance for a train. In some embodiments, systems use smaller wheels riding on the guideway to steer the vehicle using conventional steering arrangements like those on a car. In some embodiments, a track has two running rails with a fixed spacing that is supplemented by additional rails such as electric conducting rails (e.g., a third rail) and track rails. In some embodiments, monorails and maglev guideways are used.

In some embodiments, an odometry algorithm is configured to determine a vehicle's speed and motion direction. Additionally or alternatively, the odometry algorithm determines a stationary state and cold motion detection. In some embodiments, stationary references a vehicle standing still and described when the vehicle's speed is consistently less than 0.5 kph and accumulative displacement less than 3 cm. In some embodiments, a positioning algorithm is configured to determine the position and orientation of the vehicle on a guideway or road. In some embodiments, a dead reckoning algorithm is configured to determine a vehicle position with non-beacon sensor measurements (e.g., an IMU, tachometer, radar, or the like) in non-beacon coverage areas. Additionally or alternatively, the dead reckoning algorithm is a sub-algorithm of the positioning algorithm.

In some embodiments, a map is a diagrammatic representation of a guideway network in terms of nodes (e.g., platforms, beacon-coverage areas or the like) and edges (e.g., tracks, guideways or the like) connecting the nodes. Additionally or alternatively, the map is map stored in memory (FIG. 8 804) as a database. In some embodiments, a digital map (e.g., a map stored in memory (804) and presented on a user interface (FIG. 8 842 by processing circuitry (FIG. 8 802)) includes locations of guideway beacons 108 that have digital identifiers (ID). Additionally or alternatively, each guideway beacon 108 has a unique digital ID that is reported in real-time (e.g., part of a message transmitted by guideway beacon 108). In some embodiments, the map contains an association between the beacon's ID and it location in terms of earth-centered, earth-fixed (ECEF) coordinates and/or edge/offset as well. Additionally or alternatively, a position of the vehicle's reference point is determined in terms of the edge identification (ID) and the offset along the edge both in a positive and negative direction of travel (e.g., where is the vehicle on a guideway, what is its orientation and direction of motion and the like).

In some embodiments, orientation is the direction, with respect to the map, to the end of the vehicle (e.g., a vehicle first end 106 or a vehicle second end 107) with the beacon sensors (e.g. UWB beacons) used to initialize (e.g., during a cold start) the vehicle position orientation (e.g., a positive orientation for vehicle 104A or negative orientation for possible vehicle location 104B (indicated in dotted lines)). In some embodiments, beacon coverage area is a guideway area equipped with guideway beacons 108 enabling vehicles equipped with vehicle beacons 102 to determine the range to guideway beacons 108 installed on guideway 110 within this beacon coverage area and determine the vehicle's position and speed. Additionally or alternatively, vehicle beacons 102 are range measurement devices installed on vehicle 104 and guideway beacons 108 are range measurement devices installed on guideway 110.

In some embodiments, the PAOS 100 includes one or more vehicle(s) 104A equipped with vehicle beacons 102. Additionally or alternatively, vehicle beacons 102 are coupled to a vehicle body 111 at a first vehicle end 106 and a second vehicle end 107. In some embodiments, first vehicle end 106 and second vehicle end 107 are equipped with two (2) vehicle beacons 102. In some embodiments, for positioning and odometry algorithms two (2) beacons are at a single (1) end of vehicle 104A (either first vehicle end 106 or second vehicle end 107; see FIG. 1) or one (1) vehicle beacon 102 at both vehicle ends 106, 107 of vehicle 104 (one beacon at first vehicle end 106 and the other beacon at second vehicle end 107) for distance and speed data for the positioning and odometry algorithms.

Figure 6:
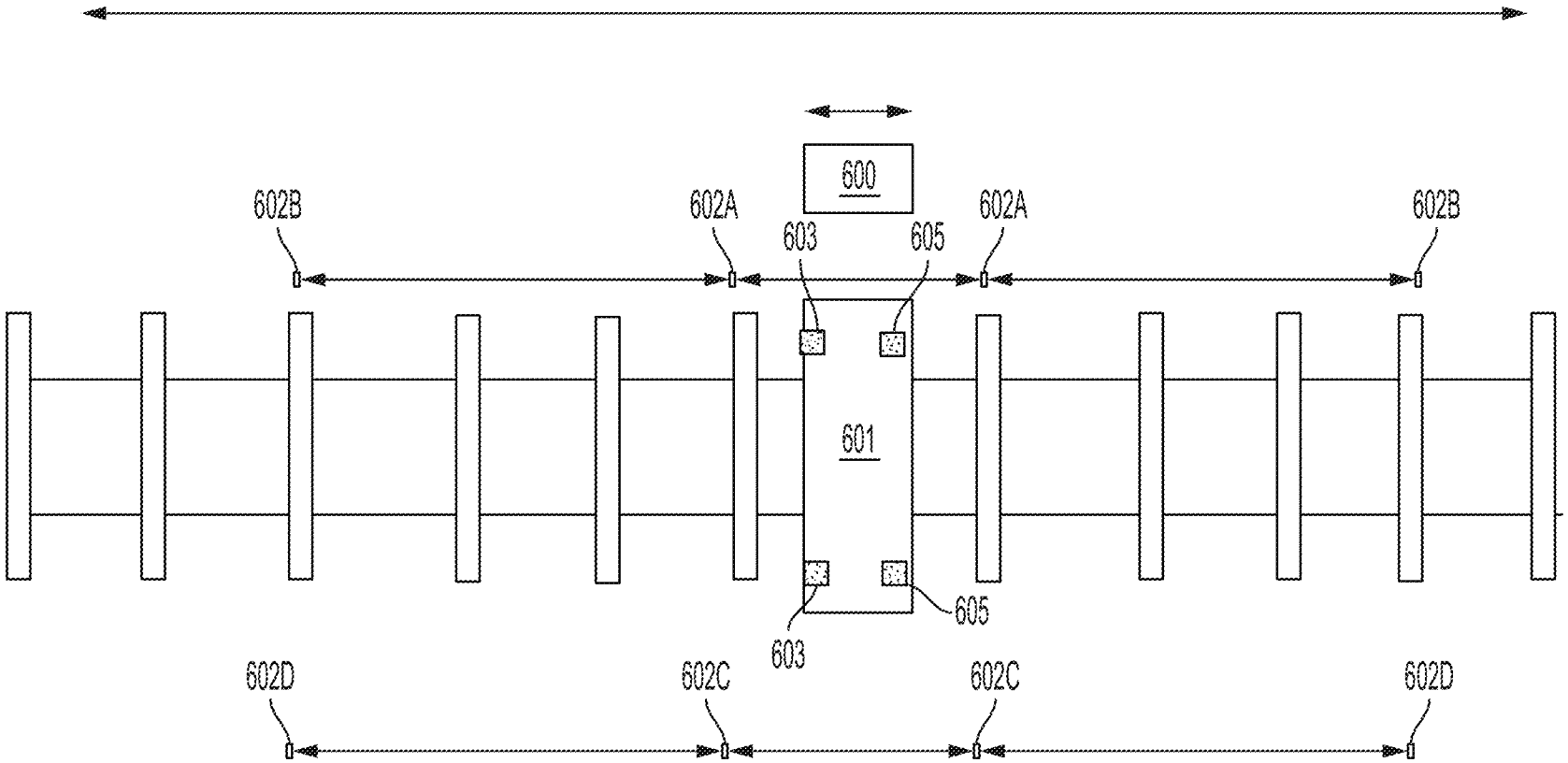
FIG. 6 is a pictorial diagram of platform beacon coverage, in accordance with some embodiments.

In some embodiments, guideway 110 with guideway beacon coverage is a platform area (see FIG. 6). Additionally or alternatively, a switch zone (e.g., a mechanical installation enabling railway trains to be guided from one guideway to another, such as at a railway junction) or other critical location includes guideway beacon coverage to support the high level of safety integrity (e.g., SIL-4) of the positioning and odometry algorithms.

In some embodiments, distance and speed measurements are determined every 100 msec (e.g., beacon measurements are taken at 100 Hz). Additionally or alternatively, when the beacon measurements are taken at a higher frequency the time period is made shorter than 10 msec. In some embodiments, processing circuitry (802) determines an average position based on beacon measurements, an average position based on the dead reckoning algorithm, an average speed based on beacon measurements, an average speed based on non-beacon measurements, a dead reckoning positioning precision (a), and a non-beacon speed precision (a). In some embodiments, precision is the degree that measurements are close to each other. In some embodiments, accuracy is the degree that a measurement is close to the actual value.

In some embodiments, in beacon coverage areas the PAOS 100 is implemented using vehicle beacons 102 (installed on-board vehicle 104 or on vehicle body 111) and guideway beacons 108 (installed on guideway 110). In some embodiments, there are several aspects to the positioning algorithm. For example, in some embodiments, in a cold start condition, positioning algorithm determines whether vehicle 104 is positioned on the correct guideway 110. A situation where vehicle 104 is positioned on the wrong guideway is hazardous.

In some embodiments, after vehicle 104 is determined to be positioned on the correct guideway, the positioning algorithm determines where the vehicle's position on the correct guideway is correct. A situation where vehicle 104 is positioned on the correct guideway, but at a wrong location or in the correct location but with a larger uncertainty than the uncertainty determined by the positioning algorithm is hazardous.

In some embodiments, the positioning algorithm determines a vehicle's direction of travel on guideway 110. In a situation where the vehicle's direction of travel on the guideway is incorrect, the situation is hazardous.

In some embodiments, the odometry algorithm provides a vehicle's speed on guideway 110 along with a speed uncertainty and motion direction of the vehicle (i.e., in the direction of motion from second end 107 to first end 106 or from first end 106 to second end 107). A situation where the vehicle speed uncertainty is greater than the uncertainty determined by the odometry algorithm is hazardous.

In some embodiments, the odometry algorithm provides a stationary state determination to indicate if vehicle 104 is moving or stationary. A situation where vehicle 104 is moving while the system determines vehicle 104 is stationary is hazardous. Further, a situation where vehicle 104 is stationary when PAOS 100 determines vehicle 104 is moving is hazardous as well.

In some embodiments, the odometry algorithm provides cold motion detection to determine whether vehicle 104 moved while the processing circuitry (802) was shutoff. A situation where vehicle 104 was moved while processing circuitry (802) was shutoff and the odometry algorithm positions vehicle 104 on a guideway location known before the move is hazardous.

In some embodiments, positioning and odometry algorithms provide cold start guideway occupancy & positioning determination with beacon range data, position update with beacon range data, speed & motion direction determination with beacon range data, stationary state determination with beacon range data, cold motion detection, dead reckoning positioning in non-beacon coverage areas, and speed & motion direction determination in non-beacon coverage areas.

In some embodiments, cold start guideway occupancy & positioning determination using beacons 102 and 108 determine what guideway 110 vehicle 104A occupies and the vehicle's position on guideway 110 upon cold start. In some embodiments, ranges (e.g., $R_1$, $R_2$, $R_3$, and $R_4$) are measured from beacons 102 on vehicle 104A to beacons 108 installed on guideway 110. In some embodiments, guideway beacons 108 are installed at the extremities of multi-guideways when the beacon coverage area contains multiple guideways (see FIG. 2), or at the extremities of guideway 110 if the guideway coverage area contains a single guideway (see FIG. 1).

In some embodiments, range $R_1$ is determined from vehicle's right beacon 102A to guideway beacon 108A. Range $R_2$ is determined from vehicle's right beacon 102A to beacon 108B. Range $R_3$ is measured from vehicle's left beacon 102B to beacon 108A. Range $R_4$ is measured from vehicle's left beacon 102B to guideway beacon 108B. In some embodiments, lateral offset 112 ($W_A$) is a lateral offset of guideway beacon 108A with respect to guideway centreline 114 (e.g., a positive value if lateral offset 112 is pointing left). Lateral offset 116 ($W_B$) is a lateral offset of guideway beacon 108B lateral offset with respect guideway centerline 114 (e.g., a positive value if lateral offset is pointing right). Longitudinal offset 118 ($\Omega_B$) is a longitudinal offset of guideway beacon 108B with respect to guideway beacon 108A (e.g., a positive value if direction is positive). Distance w is the distance between beacons 102A, 102B on the same vehicle 104A.

In some embodiments, position determination and orientation of vehicle 104 on guideway 110 is determined as follows: the vehicle orientation is positive and in the location indicated by vehicle 104A when $$R_1-R_3<-\Delta R_{Min}, \text{ and}$$

$$R_2-R_4>\Delta R_{Min}.$$

In some embodiments, ranges $R_1$, $R_2$, $R_3$, and $R_4$ provide the orientation for vehicle 104A, but also provide the position on guideway 110. In some embodiments, $\Delta R_{Min}$ is a minimum range difference between two (2) range measurements required to ensure the discrimination of guideway 110 vehicle 104A is occupying is performed with a sufficient confidence level suitable for SIL-4 applications. Additionally or alternatively, 5 cm or greater is a typical value for $\Delta R_{Min}$. In some embodiments, determination of $\Delta R_{Min}$ is considered a range measurement error for the determination of the range to guideway beacons 108A, 108B. For example, if a single range measurement error is 2 cm then $\Delta R_{Min}$ is greater than two (2) times the range measurement error. In some embodiments, the range measurement error is a property of guideway beacon 108. Additionally or alternatively, the range measurement error is reported together with the range measurement itself and sometimes it is determined offline. In some embodiments, the range measurement error is typically expressed in terms of error (e.g. 3 cm) with a confidence level (e.g. 3σ) (e.g., 99.8% of the measurements have an error of 3 cm or less). In this example $\Delta R_{Min}>4$ cm+margin. In some embodiments, the shorter the range to guideway beacons 108A, 108B in determining the position of vehicle 104A, the greater $\Delta R_{Min}$ (see FIGS. 9-12).

In some embodiments, the vehicle position is determined and orientation is negative as shown by dotted line vehicle 104B when:

$$R_1-R_3>\Delta R_{Min}, \text{ and}$$

$$R_2-R_4<-\Delta R_{Min}.$$

In some embodiments, ranges $R_1$, $R_2$, $R_3$, and $R_4$ provide the orientation for vehicle 104B, but also provide the position on guideway 110. In some embodiments, when vehicle 104A or 104B begin moving and the motion direction is determined then the vehicle correlation with a map is determined. In some embodiments, correlation is between the vehicle orientation and the vehicle motion direction. For example, when the orientation is positive and the motion direction is from vehicle second end 107 to vehicle first end 106, the correlation is positive (e.g., vehicle 104A is moving towards beacons 108). In another example, when the orientation is positive and the motion direction is from vehicle first end 106 to vehicle second end 107, the correlation is negative (e.g., vehicle 104A is moving away from beacons 108). In another example, when the orientation is negative and the motion direction is from vehicle second end 107 to vehicle first end 106, the correlation is negative (e.g., vehicle 104B is moving towards beacons 108). In another example, when the orientation is negative and the motion direction is from vehicle first end 106 to vehicle second end 107, the correlation is positive (e.g., vehicle 104B is moving away from beacons 108).

In some embodiments, the positioning algorithm determines where vehicle 104 is on guideway 110 during a cold start based on range measurements. Additionally or alternatively, a single guideway scenario, such as shown in FIG. 1, is not always the situation and in order to maintain a SIL-4 the positioning algorithm also operates effectively when multiple guideways are involved.

Figure 2:
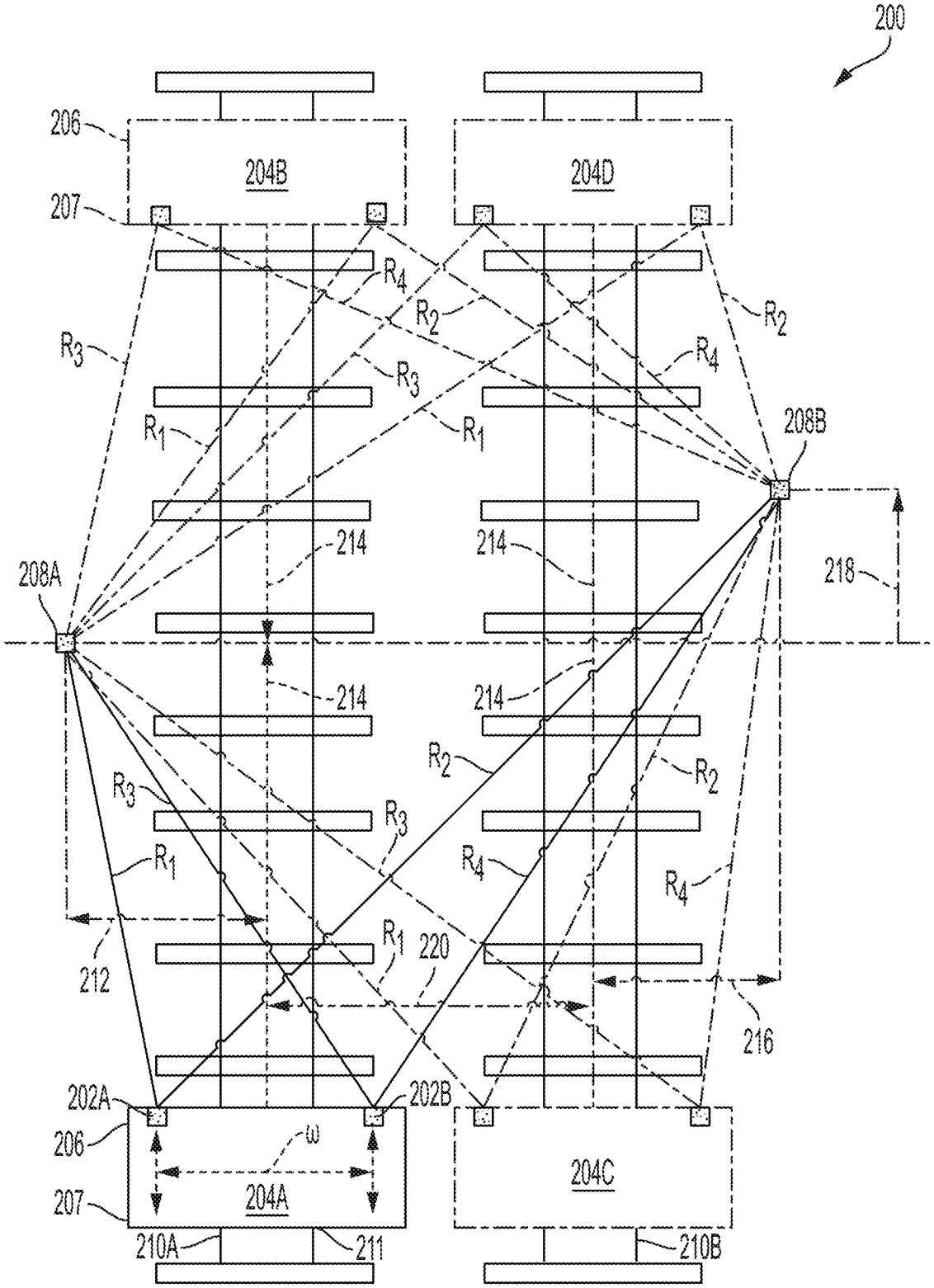
FIG. 2 is a graphical representation of a multi-guideway PAOS, in accordance with some embodiments.

FIG. 2 is a graphical representation of a multi-guideway PAOS 200, in accordance with some embodiments. In some embodiments, a non-transitory computer-readable storage medium (804 FIG. 8), comprising executable instructions (806 FIG. 8), such as positioning algorithm and odometry algorithm, that, when executed by processing circuitry (802 FIG. 8), cause processing circuitry (802) to: determine, with range measurements between one or more vehicle beacons 202A, 202B (hereinafter referred to as vehicle beacon 202) installed on an end 206 of a vehicle 204A and configured to communicate with one or more guideway beacons 208A, 208B (hereinafter referred to as guideway beacon 208) positioned at predetermined locations along one or more guideways 210A, 210B (hereinafter guideway 210), after processing circuitry (802) wakes from a sleep state, vehicle position and guideway occupancy are determined to determine a change in the vehicle position from before processing circuitry (802) entering the sleep state; determine, with the range measurements between vehicle beacons 202 and guideway beacons 208, a periodic vehicle position update; determine, with the range measurements between vehicle beacons 202 and guideway beacons 208, a vehicle speed and a vehicle direction of motion on guideway 210; determine, with the range measurements between vehicle beacon 202 and guideway beacon 208, a vehicle stationary state; determine dead-reckoning positioning; and determine the vehicle speed and the vehicle direction of motion in areas with no guideway beacons.

In some embodiments, PAOS 200 with vehicle beacon 202 on vehicle 204A, whether on vehicle first end 206 and/or vehicle second end 207, and guideway beacon 208 along guideway 210 are like PAOS 100 with vehicle beacon 102 on vehicle 104A, whether on vehicle first end 106 and/or vehicle second end 107, and guideway beacon 108 along guideway 110.

In some embodiments, the positioning algorithm discriminates between two (2) or more guideways 210A, 210B vehicle 204A possibly occupies. Additionally or alternatively, an orientation of vehicle 204A on guideway 210 with respect to the map is performed by comparing the following range pairs:

(a) $R_1-R_3$.
(b) $R_1-R_4$.
(c) $R_2-R_3$.
(d) $R_2-R_4$.

In some embodiments, when $R_1-R_2>\Delta R_{Min}$, $R_1-R_4>\Delta R_{Min}$, $R_3-R_2>\Delta R_{Min}$ and $R_3-R_4>\Delta R_{Min}$ then vehicle 204A occupies guideway 210B in either vehicle location 204C or vehicle location 204D. Additionally or alternatively, when $R_1-R_2<R_1-R_4<-\Delta R_{Min}$, $R_3-R_2<-\Delta R_{Min}$ and $R_3-R_4<-\Delta R_{Min}$ then vehicle 204 occupies guideway 210A as vehicle 204A or at vehicle location 204B. In some embodiments, when a guideway occupancy is known using the range equations directly above, a location on guideway 210 is determined using the equations from above:

$$Is,\ R_1-R_3<-\Delta R_{Min}, \text{ and}$$

$$R_2-R_4>\Delta R_{Min}. \text{ Or}$$

$$Is,\ R_1-R_3>\Delta R_{Min}, \text{ and}$$

$$Is,\ R_2-R_4<-\Delta R_{Min}$$

As discussed above and in some embodiments, $\Delta R_{Min}$, is the minimum range difference between two (2) range measurements required to ensure the positioning algorithmic discrimination between guideways 210A and 210B for vehicle 204A to occupy is performed with a sufficient confidence level suitable for a SIL 4 function. In some embodiments, 5 cm or greater is typical value for $\Delta R_{Min}$. Additionally or alternatively, determination of $\Delta R_{Min}$ should consider the range measurement error and the range to guideway beacons 208 as well. For example if a single range measurement error is 2 cm then $\Delta R_{Min}$ must be greater than two (2) times the range measurement error. In this example $\Delta R_{Min}$>4 cm+margin. The shorter the range to the anchors in determining the position the greater $\Delta R_{Min}$. See FIGS. 9-12.

In some embodiments, and with reference to FIGS. 9-12 an example depicting $R_1$-$R_2$ (FIG. 9), $R_1$-$R_4$ (FIG. 10), $R_3$-$R_2$ (FIG. 11) and $R_3$-$R_4$ (FIG. 12) for a multiple guideway such as shown in FIG. 2, is shown assuming the following parameters:

(a) W (distance between guideway centerlines 220)=5 m.
(b) $w_A$ (lateral offset 212 to guideway beacon 208A)=2 m.
(c) $w_B$ (lateral offset 216 to guideway beacon 208B)=2 m.
(d) ω (distance between vehicle beacons 202 on same vehicle)=2 m.
(e) $\Omega_B$ (longitudinal offset 218 of guideway beacons 208A and 208B)=0 m.

Figure 9:
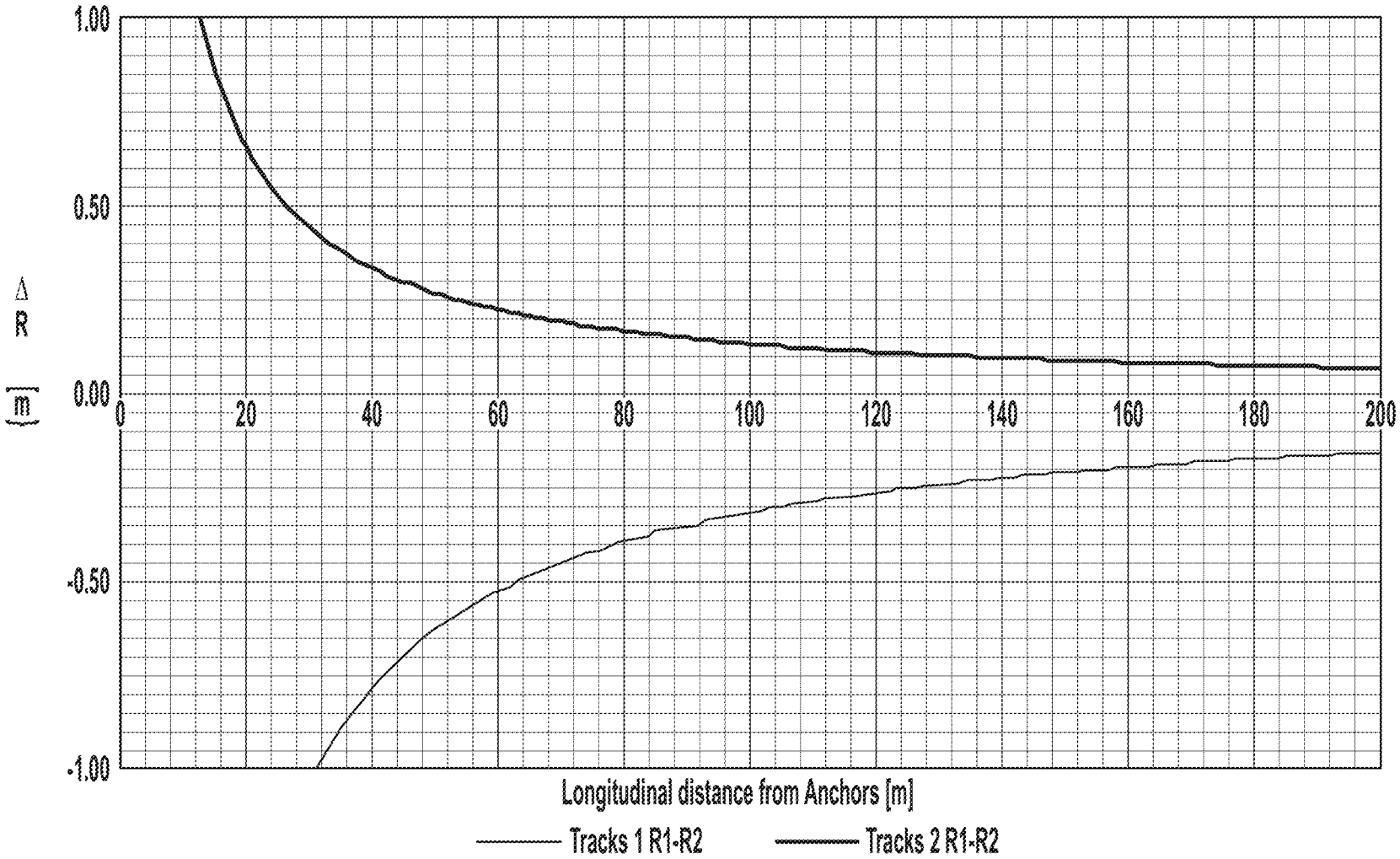
FIG. 9 is a graphical representation of $R_1$-$R_2$ values as a function of longitudinal distance between anchors, in accordance with some embodiments.
Figure 10:
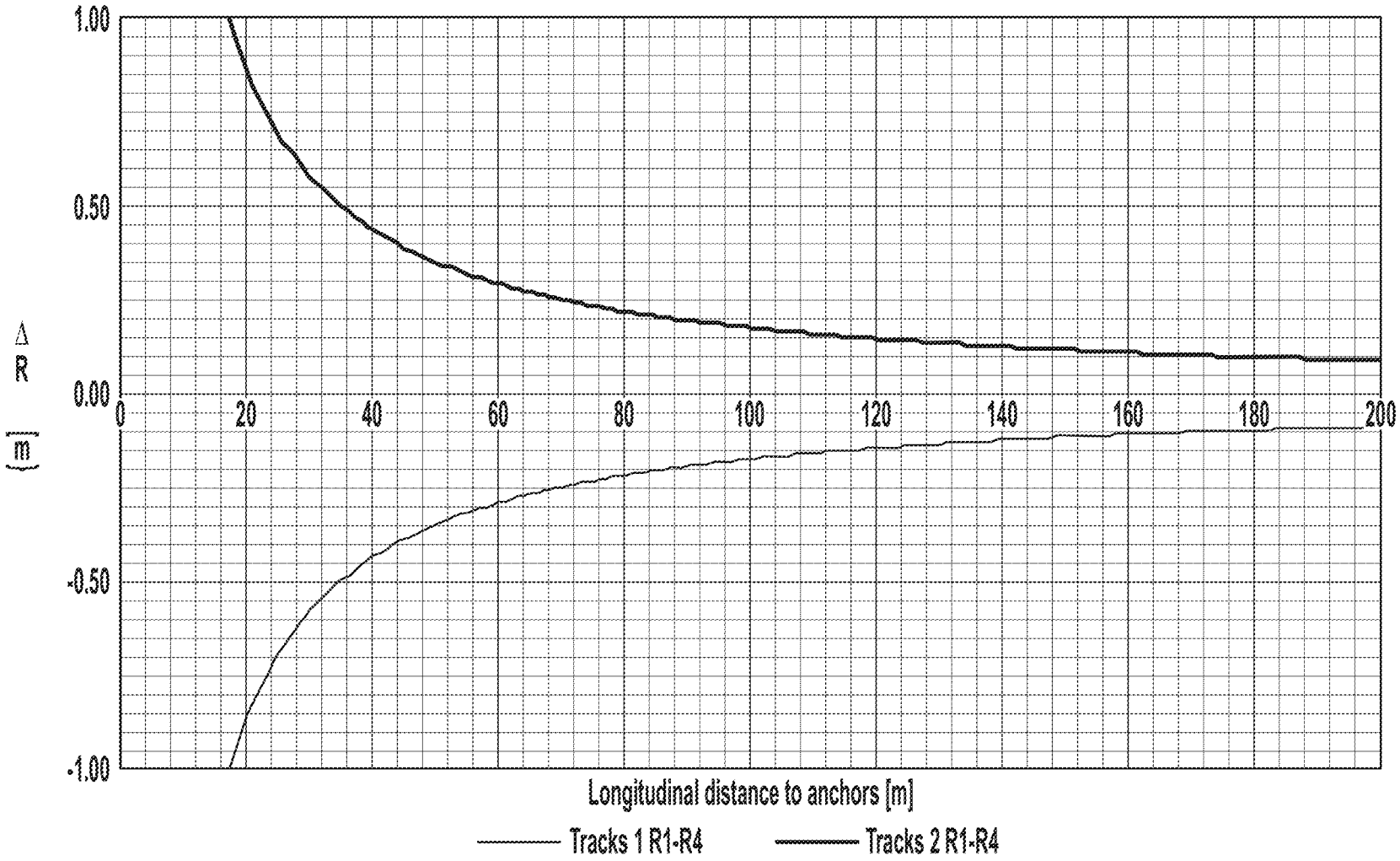
FIG. 10 is a graphical representation of $R_1$-$R_4$ values as a function of longitudinal distance between anchors, in accordance with some embodiments.
Figure 11:
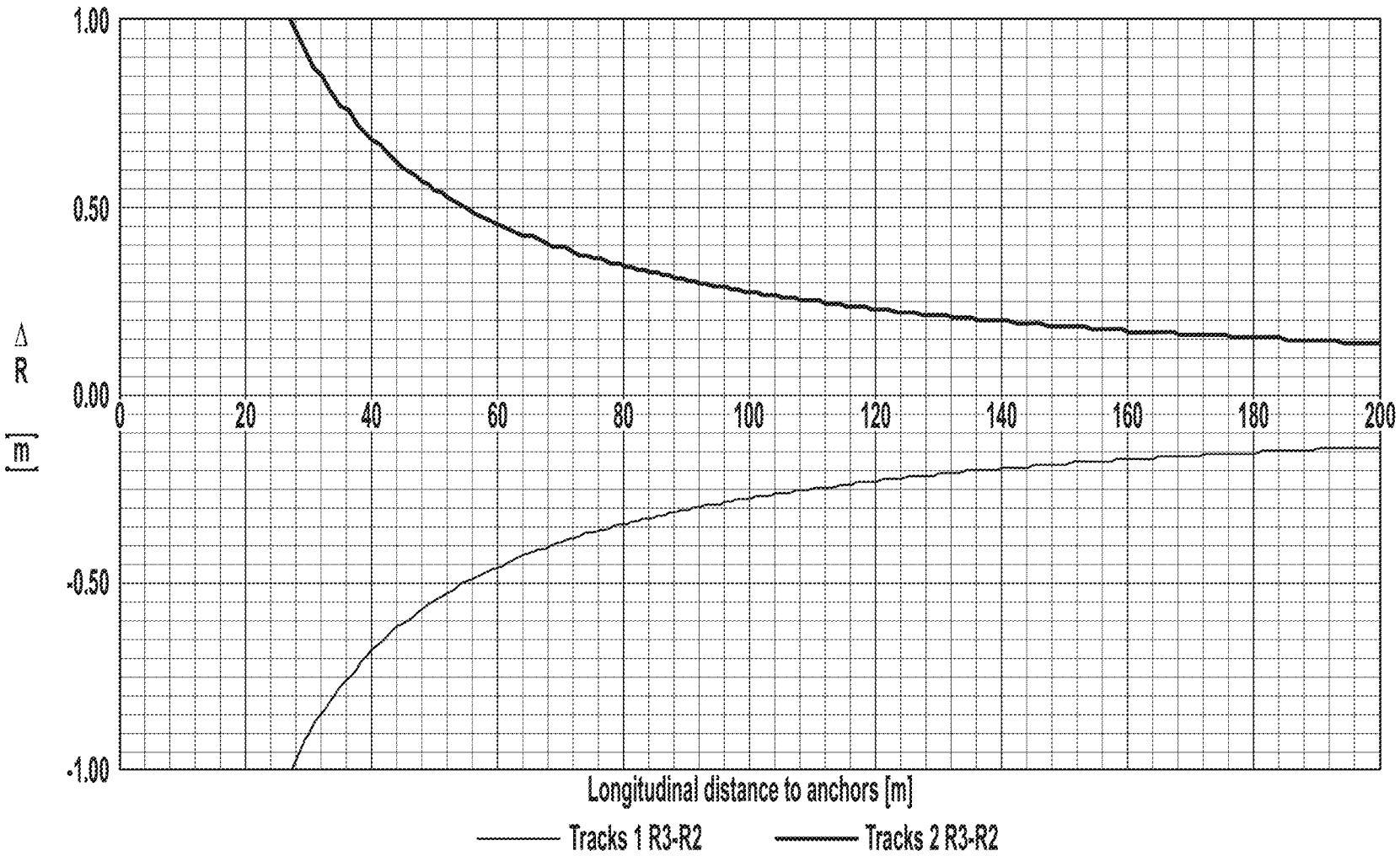
FIG. 11 is a graphical representation of $R_3$-$R_2$ values as a function of longitudinal distance between anchors, in accordance with some embodiments.
Figure 12:
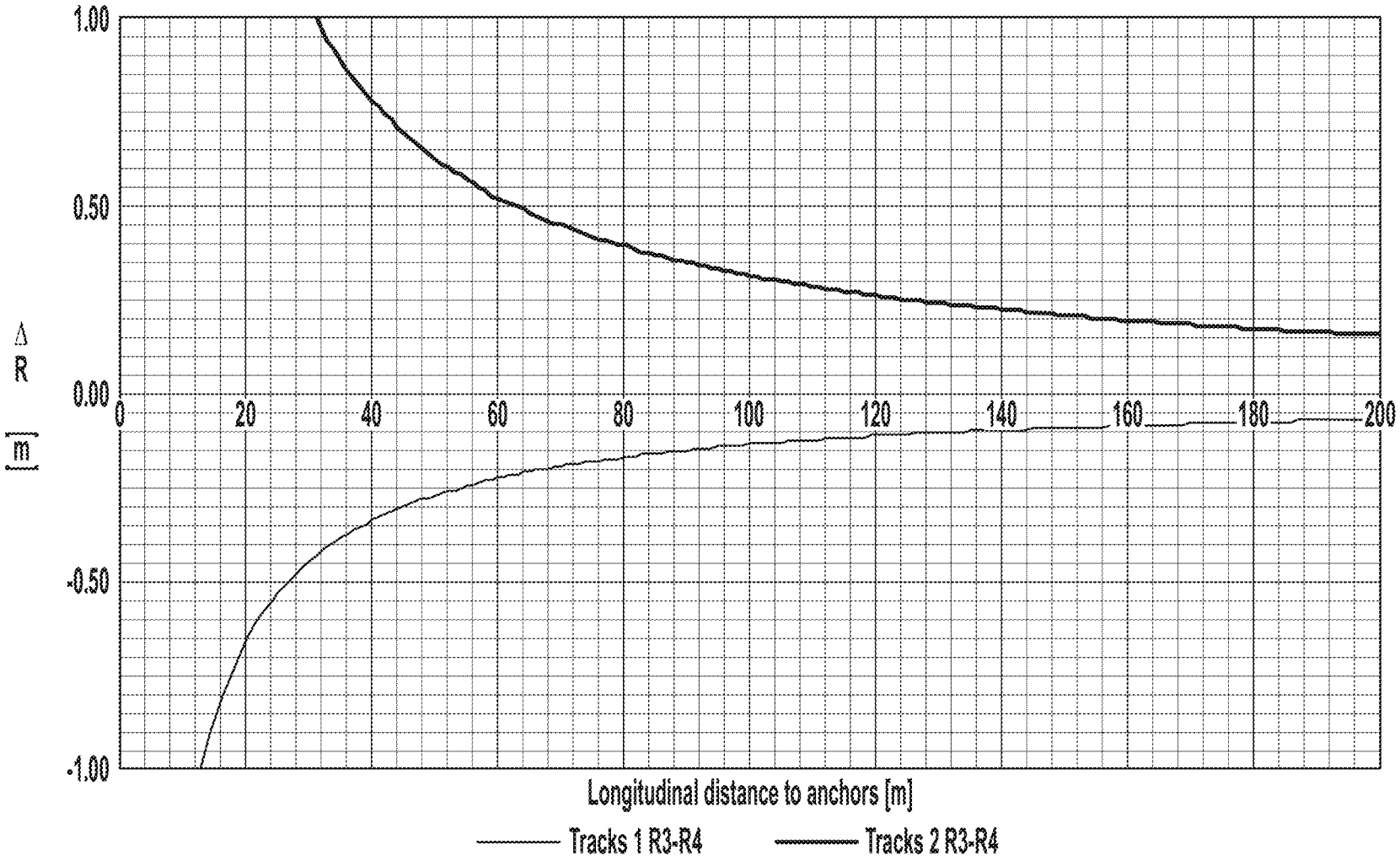
FIG. 12 is a graphical representation of $R_3$-$R_4$ values as a function of longitudinal distance between anchors, in accordance with some embodiments.

In some embodiments, as seen in FIG. 9, ΔR is shown for $R_1$-$R_2$ values for guideways 210A and 210B as a function of the longitudinal distance from vehicle beacon(s) 202 to guideway beacons 208. In some embodiments, at 200 m ΔR is approximately 20 cm. In some embodiments, it is possible to determine what track the vehicle is on based upon FIGS. 9-12. Additionally or alternatively, the sign of ΔR presents an indication as to the tracks the vehicle occupies.

Figure 3:
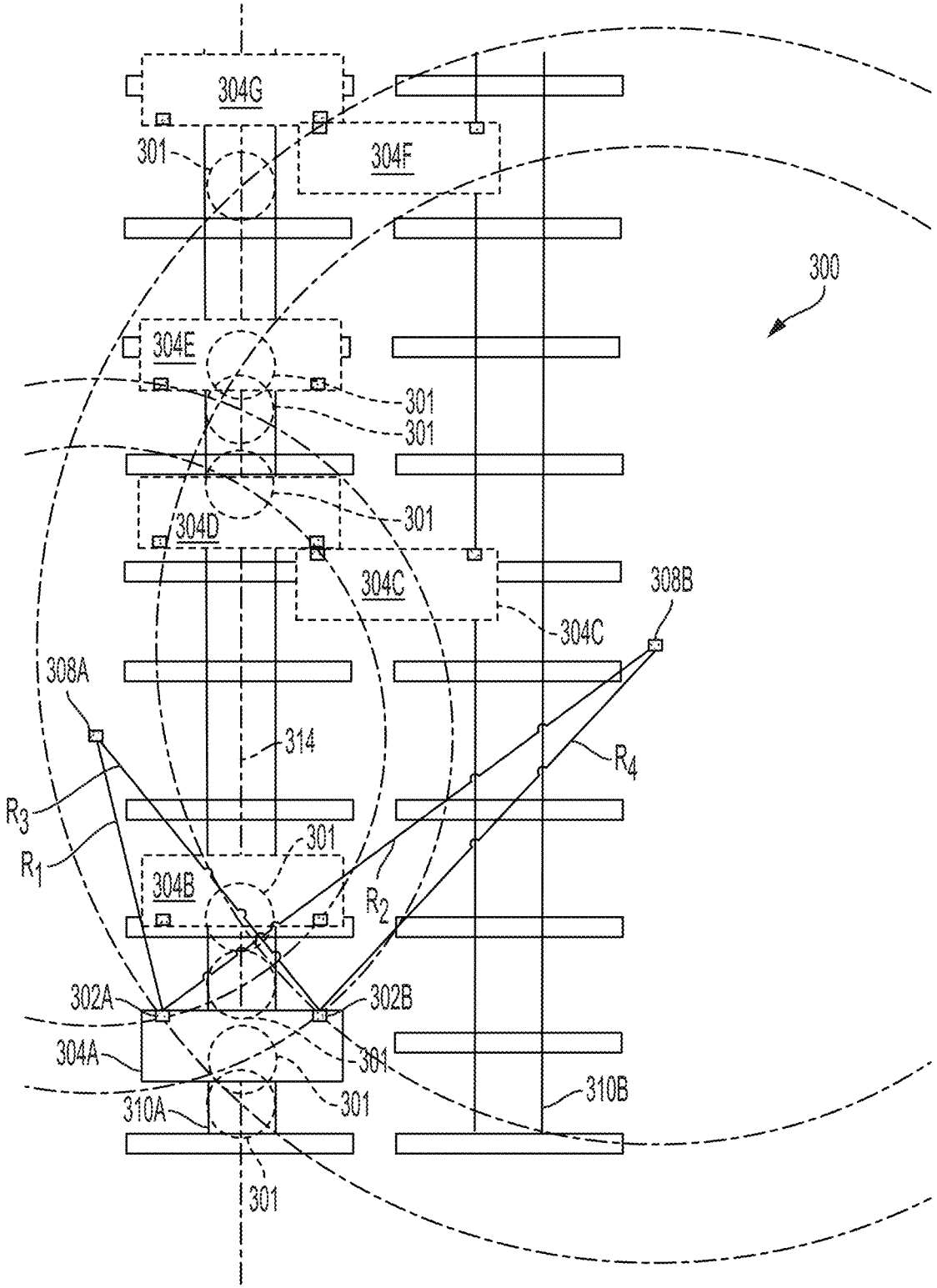
FIG. 3 is a graphical representation of vehicle positioning along a guideway, in accordance with some embodiments.

FIG. 3 is a graphical representation of vehicle positioning along a guideway, in accordance with some embodiments. In some embodiments, PAOS 300 with vehicle beacon(s) 302A, 302B (hereinafter vehicle beacons 302) on vehicle 304A, and guideway beacons 308A, 308B (hereinafter guideway beacons 308) along guideway 310 is like PAOS 100 and 200 with vehicle beacon(s) 102 and 202 on vehicle(s) 104 and 204, and guideway beacon(s) 108, 208 along guideway(s) 110 and 210.

In some embodiments, when a vehicle's guideway occupancy and vehicle orientation is determined, an along-guideway position (e.g., where is the vehicle at specifically along the guideway the vehicle has been determined to be located on) is determined based on an $R_1$, $R_2$, $R_3$, and $R_4$ intersections 301 with guideway centerline 314. Additionally or alternatively, typically eight (8) intersection points are observed; however, typically four (4) out of the eight (8) intersection points are consistent with unique vehicle positions along guideway 310A in consideration of vehicle beacon 302A, 302B arrangement on vehicle 304A and considering the vehicle's orientation. In some embodiments, 4 of the 8 intersections 301 are closely grouped at or near the along-guideway position represented by vehicle 304A. In some embodiments, vehicle 304A is the correct vehicle position along guideway 310A and is consistent with 4 intersections 301. Additionally or alternatively, dashed line vehicles 304B, 304C, 304D, 304E, 304F, and 304G are not consistent with any set of 4 intersection points and thus are not considered as actual along-guideway positions.

In some embodiments, the positioning algorithm verifies that a change in position along guideway centerline 314 is determined based on the four (4) range measurements ($R_1$, $R_2$, $R_3$, and $R_4$) and determines the same along-guideway position with a certain acceptable tolerance. Additionally or alternatively, the along-guideway position determined based on $R_1$ and $R_4$ overshoots the actual position along guideway 310A in the guideway direction vehicle 304A is oriented with, and the along-guideway position determined based on $R_2$ and $R_3$ undershoots the actual position along guideway 310A with respect to the same guideway direction.

Figure 13:
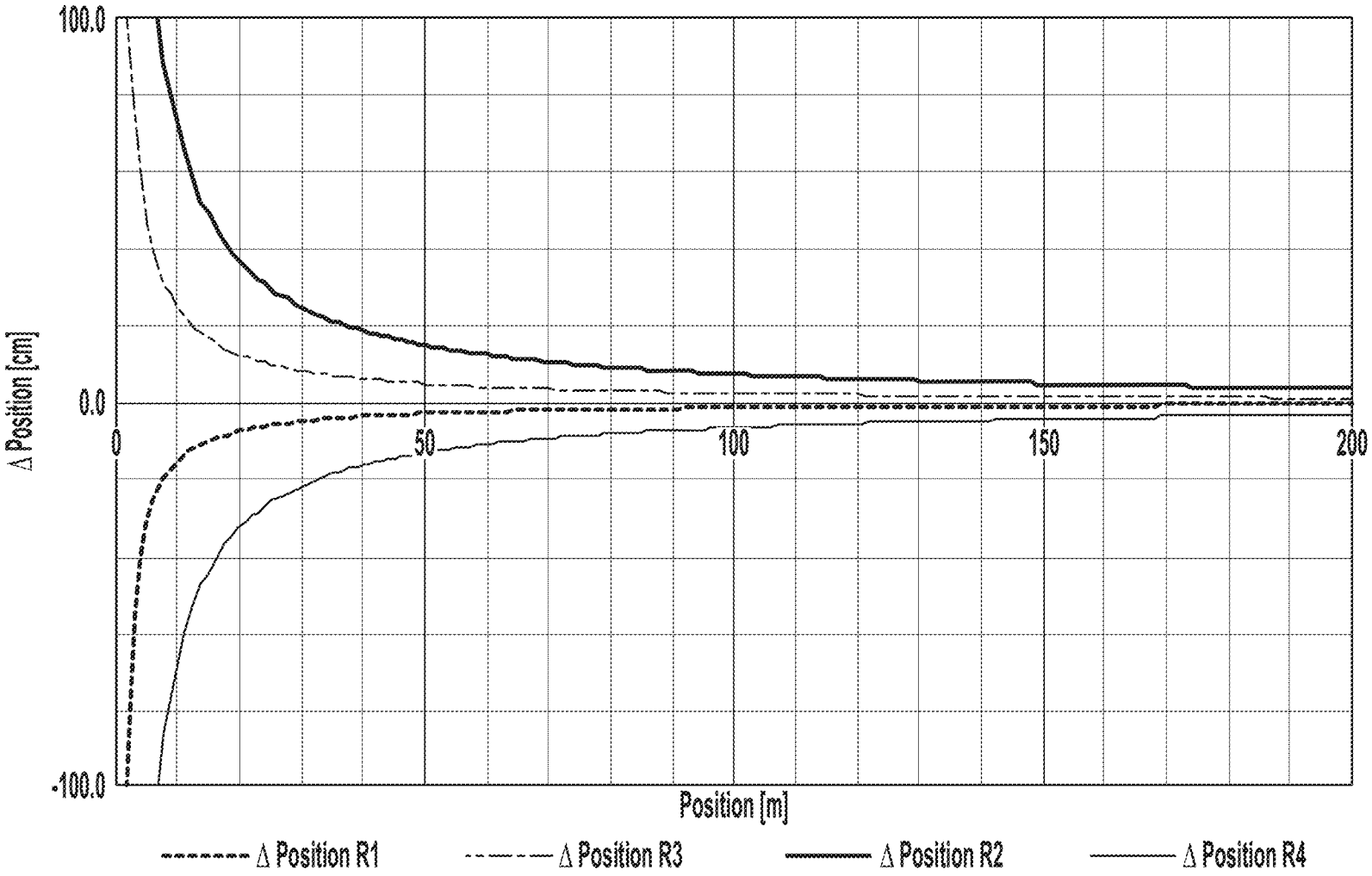
FIG. 13 is a graphical representation of the change in actual position and determined position, in accordance with some embodiments.

In some embodiments, FIG. 13 depicts the delta (e.g., change in position over distance) between the actual position, based on the measured ranges $R_1$, $R_2$, $R_3$, and $R_4$, and the along-guideway position, discussed above, determined for a vehicle with positive orientation on a guideway.

In some embodiments, delta (Δ) or change between the actual position using beacon ranges and the along-guideway position determined based on the measured ranges $R_1$, $R_2$, $R_3$, and $R_4$ is corrected by the positioning algorithm based on a measured range and the lateral distance between guideway beacon 308 and guideways centerline 314. In some embodiments, FIG. 15 depicts the delta positions for a vehicle on guideway 310A and guideway 310B with positive and negative orientations.

In some embodiments, once a vehicle's guideway occupancy, vehicle orientation and along-guideway position is determined, and the vehicle starts to move, then a motion direction and correlation are determined too. Additionally or alternatively, a single range ($R_1$, $R_2$, $R_3$ or $R_4$) measurement is sufficient to update the vehicle's along-guideway position on the guideways centerline. In some embodiments, the determination of the vehicle's guideway occupancy, vehicle orientation and along-guideway position is desired before determining the vehicle motion direction and correlation. Additionally or alternatively, positioning algorithm and the odometry algorithm actively determine any of vehicle's guideway occupancy, vehicle orientation, along-guideway position vehicle motion, and vehicle direction and correlation independently of one another with neither aspect being performed before the other is determined. However, for purposes of safety, some determinations are made before others as discussed above in detail.

Figure 4:
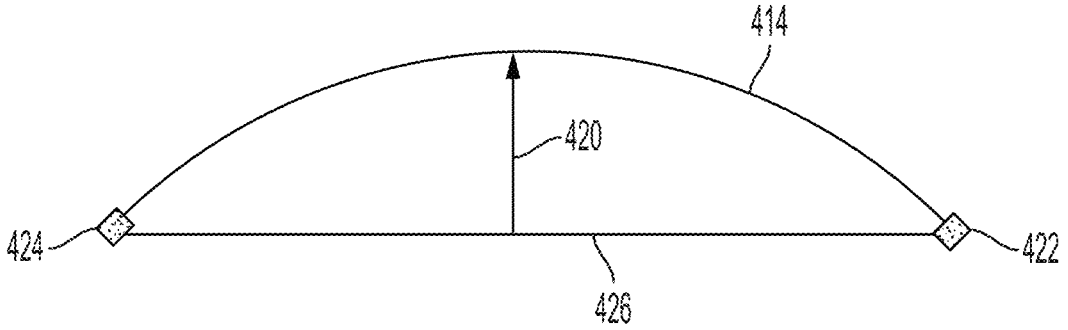
FIG. 4 is a high-level diagram of beacon speed determination, in accordance with some embodiments.

FIG. 4 is a high-level diagram of beacon speed determination, in accordance with some embodiments. In some embodiments, guideway centerline 414 is a 3-D curve (e.g., to account for the curvature of the Earth or due to constraints imposed by the guideway construction design). Additionally or alternatively, once an along-guideway position is established and then updated in a certain refresh rate (e.g., every 100 msec or at 50 Hz), the vehicle's speed is determined based on the derivative (ratio) of dP/dt (ΔP [change in position]/Δt [change in time]). In some embodiments, the odometry algorithm also accounts for guideway curvature 420 to ensure that ΔP is the arc length between a first determine position 422 and a second determined position 424 and not a cord 426 between first position 422 and second position 424. In some embodiments, when the refresh rate is high the difference between the two is negligible otherwise the difference is significant. Additionally or alternatively, the difference is a function of the refresh rate and the train speed. For a train moving at 100 kph, ΔP=1.4 m for refresh rate of 50 msec, 2.8 m for refresh rate of 100 msec, and 14 m for refresh rate of 500 mse. For a train moving at 5 kph ΔP=7 cm for refresh rate of 50 msec, 14 cm for refresh rate of 100 msec and 70 cm for refresh rate of 500 msec.

In some embodiments, the speed is derived from two (2) positions where: (1) the difference in the along guideways distance (e.g., the arc length of centerline 414) between the two (2) positions is greater than 10 times the positioning error; (2) the difference in the along guideways distance (e.g., arc length of centerline 414) between the two (2) positions is less than 100 times the positioning error. Additionally or alternatively, when the arc length of centerline 414 between first position 422 and second position 424 is not less than 10 times the positioning error (e.g., potentially causing the derived speed to be noisy (e.g., affected by the positioning error)) and not greater than 100 times the arc length of centerline 414 between first position 422 and second positon 424 to prevent inaccurate measurements the most accurate speed is derived by the odometry algorithm. Additionally or alternatively, the speed error can be expressed as $V_{err}=2P_{err}/\Delta t+2\Delta Pt_{err}/\Delta t^2$. In some embodiments, in order to avoid noisy speed, a larger Δt is preferred that typically is related with a larger ΔP too. Additionally or alternatively, the speed is calculated as a derivative of the position. In some embodiments, the derivative is noisy; therefore relaxing (e.g., lengthening) the Δt reduces the derivative noise. In some embodiments, this means that the derivative is not calculated based on consecutive measurements. Additionally or alternatively, a measurement is taken (e.g., P1 at t1) then the next measurement used for ΔP and Δt should be Pn, to not P2, t2.

In some embodiments, when the vehicle is in a beacon coverage area and at least a single range measurement (e.g., one of $R_1$, $R_2$, $R_3$ or $R_4$) is available, and the value of the measured range does not change, or if the value of the measured range changed within a certain predefined bound (e.g., $\pm\Delta R_{stationary}$ 5 cm) then the vehicle's state is determined to be stationary.

In some embodiments, before processing circuitry (802) is powered down, the along-guideway position and the trackside beacon IDs are stored within a nonvolatile memory (804). Additionally or alternatively, upon startup of processing circuitry (802) (e.g., a cold start) of a vehicle in a beacon coverage area, the vehicle's guideway occupancy, orientation and along-guideway position are determined. In some embodiments, when a change is determined with respect to the position data stored in nonvolatile memory (804) before powering down then cold motion is declared. Additionally or alternatively, when the processing circuitry (802) starts up while the vehicle is in an area without beacon coverage then cold motion is declared. In some embodiments, an alarm is sounded and/or reported to the central control as a positive or negative motion when cold motion is detected.

In some embodiments, beacon positioning, speed functions, dead reckoning positioning and odometry functions, beacon positioning information is independently determined and provided to the dead reckoning positioning and odometry algorithms at specified times. For example, beacon positioning information is provided on cold start (e.g., upon processing circuitry (802) powering up for operation), when the beacon coverage area is entered (e.g., when the vehicle is entering a beacon coverage area), before the beacon coverage area is vacated (e.g., when the vehicle is exiting a beacon coverage area), the time elapsed since a last beacon positioning update is greater than 2 minutes, or the distance travelled since the last beacon positioning update is greater than 1 km. Additionally or alternatively, in providing the dead reckoning algorithm with the beacon positioning information at these times, provides the dead reckoning algorithm with the most accurate positioning information before the vehicle utilizes dead reckoning positioning.

In some embodiments, dead reckoning positioning is a position determined using non-beacon measurements. Additionally or alternatively, a beacon coverage area is maximized with beacons and allows for coverage gaps without compromising the SIL-4 function. In some embodiments, beacon installation is in a platform area (see FIG. 6) in which a guideway stretch (e.g., 2000 m) alternates beacon coverage. For example, in some embodiments, 1100 m are provided with beacon coverage while the areas without beacon coverage are no longer than 150 m.

In some embodiments, in beacon coverage areas, the odometry algorithm estimates the speed based on a beacon positioning error and a beacon positioning error's influence on a beacon based speed error to minimize the speed error. Additionally or alternatively, the dead reckoning positioning bias and the non-beacon speed bias are compensated and supervised. In some embodiments, the dead reckoning positioning bias, for a specified time interval, is the difference between the average position determined based on the dead reckoning positioning function (e.g., using the beacon measurements for initialization only) and the average position solely determined based on beacon measurements. In some embodiments, a dead reckoning positioning protection level is verified against the beacon position. Additionally or alternatively, the positioning precision is estimated in consideration of the dead reckoning positioning precision and the beacon positioning precision. In some embodiments, the speed precision is estimated based on the non-beacon speed precision and the beacon speed precision. In some embodiments, non-beacon speed is the speed determined using non-beacon speed measurements (e.g., IMU data).

In some embodiments, in areas without beacon coverage the dead reckoning positioning and its uncertainty is compared against the positioning determined based on the integration, in the time domain, of the non-beacon speed, such as an IMU, (e.g., safety bag FIG. 5) to supervise its integrity. Additionally or alternatively, temporary portable beacons are installed in these non-beacon coverage areas to build the confidence level in the high safety integrity (SIL 4) algorithms. In some embodiments, uncertainty is an interval or distribution around a measured value, where the true value lies with some probability (e.g., confidence level).

In some embodiments, in beacon coverage areas, the along-guideway positioning is determined based on beacon measurements with a refresh rate (e.g. 5 Hz (200 ms) or higher). Additionally or alternatively, once the along guideway positioning is initialized based on beacon measurements, the position is then based on the dead reckoning positioning algorithm until the position is re-updated based on beacon measurements (e.g., typically in platform areas or switch zones). Additionally or alternatively, even though beacon measurements are available (i.e., excluding initialization) the positioning algorithm does not use the beacon measurements to determine the dead reckoning position (e.g., $P_{Dead\ Reckoning}$ vs. $P_{Beacon}$).

In some embodiments, a dead reckoning algorithm is part of the positioning algorithm and is determined based on Radar and IMU, radar, tachometer/speed sensor and IMU, tachometer/speed sensor and single axis accelerometer or any other sensor arrangement that does not include localization capability.

Figure 5A:
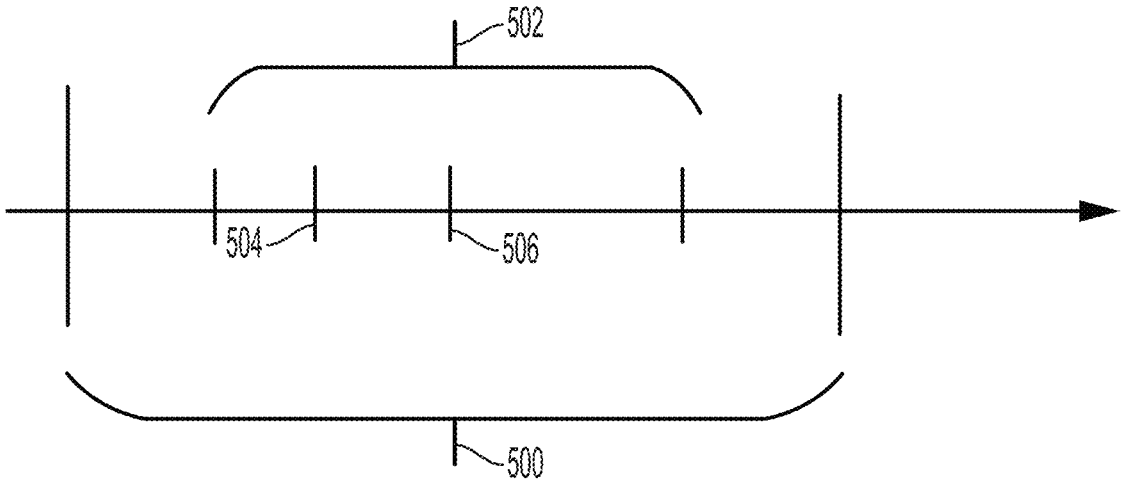
FIG. 5A is a high-level diagram of a safety bag, in accordance with some embodiments.

FIG. 5 is a high-level diagram of a safety bag 500, in accordance with some embodiments. In some embodiments, safety bag 500 is an external algorithm, implemented on independent processing circuitry and set to a different specification of the positioning and odometry algorithms. Additionally or alternatively, the safety bag algorithm is concerned with ensuring processing circuitry (802) operates within a safe zone represented by safety bag 500. In some embodiments, the safety bag algorithm continuously monitors the processing circuitry (802). Additionally or alternatively, the safety bag algorithm prevents the processing circuitry (802) from entering an unsafe state. In some embodiments, when the safety bag algorithm determines that processing circuitry (802) is entering a potentially hazardous state, the processing circuitry (802) is brought back to a safe state either by the safety bag algorithm or by processing circuitry (802). In some embodiments, the safety bag algorithm is in accord with CENELEC-EN 50128 communication, signaling and processing systems software for railway control and protection systems publication that is hereby incorporated by reference in its entirety.

In some embodiments, in beacon coverage areas, the beacon positioning ($P_{Beacon}$) serves as safety bag 500 for the dead reckoning positioning ($P_{Dead\ Reckoning}$). Additionally or alternatively, safety bag 500, provided by the beacon positioning ($P_{Beacon}$) is greater than uncertainty range 502 that encompasses true position 504 and a determined position 506 associated with the dead reckoning positioning ($P_{Dead\ Reckoning}$). In some embodiments, when the positioning algorithm determines a position outside of safety bag 500, an alarm is raised and the safety bag algorithm or the positioning algorithm implements a correction.

Figure 5B:
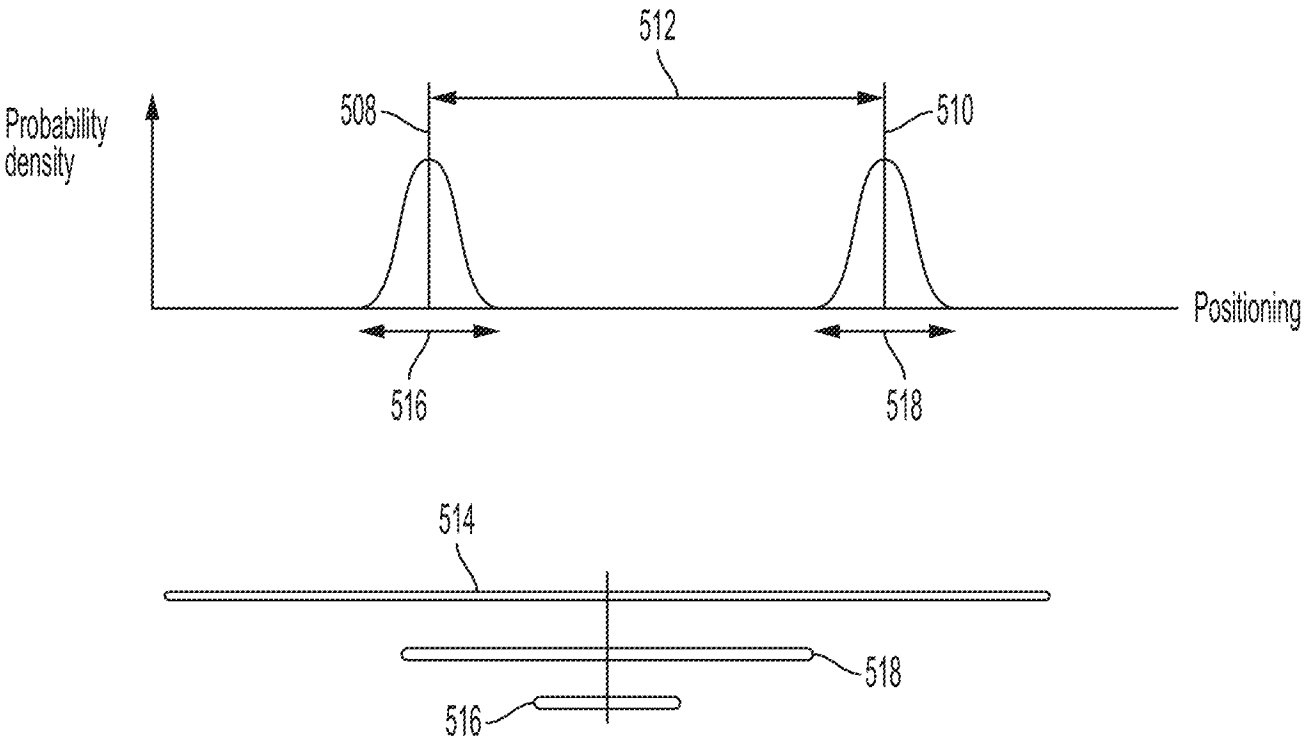
FIG. 5B is a high-level graph of position bias compensation, in accordance with some embodiments.

FIG. 5B is a high-level graph of position bias compensation, in accordance with some embodiments. In some embodiments, in beacon coverage areas, beacon positioning 508 (e.g., $P_{Beacon}$) and dead reckoning positioning 510 (e.g., $P_{Dead\ Reckoning}$) are amalgamated to remove the dead reckoning positioning bias 512 and estimate positioning uncertainty 514 (that in some embodiments is safety bag 500) based on the summation of the beacon positioning precision 516, dead reckoning positioning precision 518 and a certain margin. In some embodiments, the error in $P_{Beacon}$ is about 10 cm. additionally or alternatively, the error in $P_{Dead_Reckoning}$ starts at 10 cm and may grow to 10 m if the dead reckoning is performed over a long distance (e.g., 1 km). In some embodiments, the margin is in the range from 5 cm to 10 cm.

In some embodiments, beacon positioning 508 (e.g., $P_{Beacon}$) and dead reckoning positioning 510 (e.g., $P_{Dead\ Reckoning}$) are compared to assess dead reckoning positioning bias 512. Additionally or alternatively, the beacon coverage area provides for accurate positioning and proper calculation of dead reckoning positioning bias 512. In some embodiments, beacon coverage areas providing beacon positioning 508 ($P_{Beacon}$) serve as safety bag 500 for dead reckoning positioning 510 ($P_{Dead\ Reckoning}$). Additionally or alternatively, safety bag 500 provided by beacon positioning 508 ($P_{Beacon}$) is greater than uncertainty 502 associated with dead reckoning positioning 510 ($P_{Dead\ Reckoning}$).

In some embodiments, in beacon coverage areas beacon positioning 508 ($P_{Beacon}$) and the dead reckoning positioning 510 ($P_{Dead\ Reckoning}$) are combined to remove dead reckoning positioning bias 512 and estimate positioning uncertainty 514 based on the sum of beacon positioning precision 516, dead reckoning positioning precision 518 and a certain margin. Additionally or alternatively, in a beacon coverage area, beacon positioning 508 ($P_{Beacon}$) is the true 504 (e.g., actual) value with a negligible bias (e.g., <5 cm) and beacon positioning precision 516 is significantly smaller than dead reckoning positioning precision 518 (e.g., beacon positioning precision 516 is less than or equal to 10 cm ($\pm 3\sigma$)).

In some embodiments, in beacon coverage areas, the along guideway protection level is checked. For example, the dead reckoning positioning uncertainty ($P_{Dead\ Reckoning}$ 510$\pm P_{Dead\ Reckoning}$ Precision 518) is compared against the beacon positioning uncertainty ($P_{Beacon}$ 508$\pm P_{Beacon\ Precision}$ 516). In some embodiments, when the difference is bounded by the along tracks protection level (e.g., safety bag 500), then the along tracks protection level is trusted; otherwise an alarm is raised.

In some embodiments, in areas without beacon coverage the along guideways positioning is determined solely based on the dead reckoning positioning algorithm ($P_{Dead\ Reckoning}$). Additionally or alternatively, in areas without beacon coverage beacon positioning 508 ($P_{Beacon}$) is not available. Therefore, dead reckoning positioning bias 512 is not determined. In some embodiments, the positioning algorithm will use the last beacon measurements before leaving the beacon coverage area to re-localize the dead reckoning positioning. In some embodiments, the positioning algorithm has two sub-algorithms: (a) localization in that the position is determined by observing a landmark with known location ($P_{Beacon}$), and (b) dead-reckoning in that the position is estimated based on the last observed landmark and speed/acceleration measurements. Additionally or alternatively, before leaving a beacon coverage area the dead-reckoning position is reset to the beacon position (e.g., +/− the error) and from that point the error will grow until the next beacon is observed. In some embodiments, positioning uncertainty 514 is still determined like beacon coverage areas (e.g., the summation of beacon positioning precision 516 (e.g., fixed value) and dead reckoning positioning precision 518 and a certain margin), but dead reckoning positioning precision 518 is determined based on error estimation techniques such as the covariance matrix of a Kalman Filter or equivalent.

Figure 14:
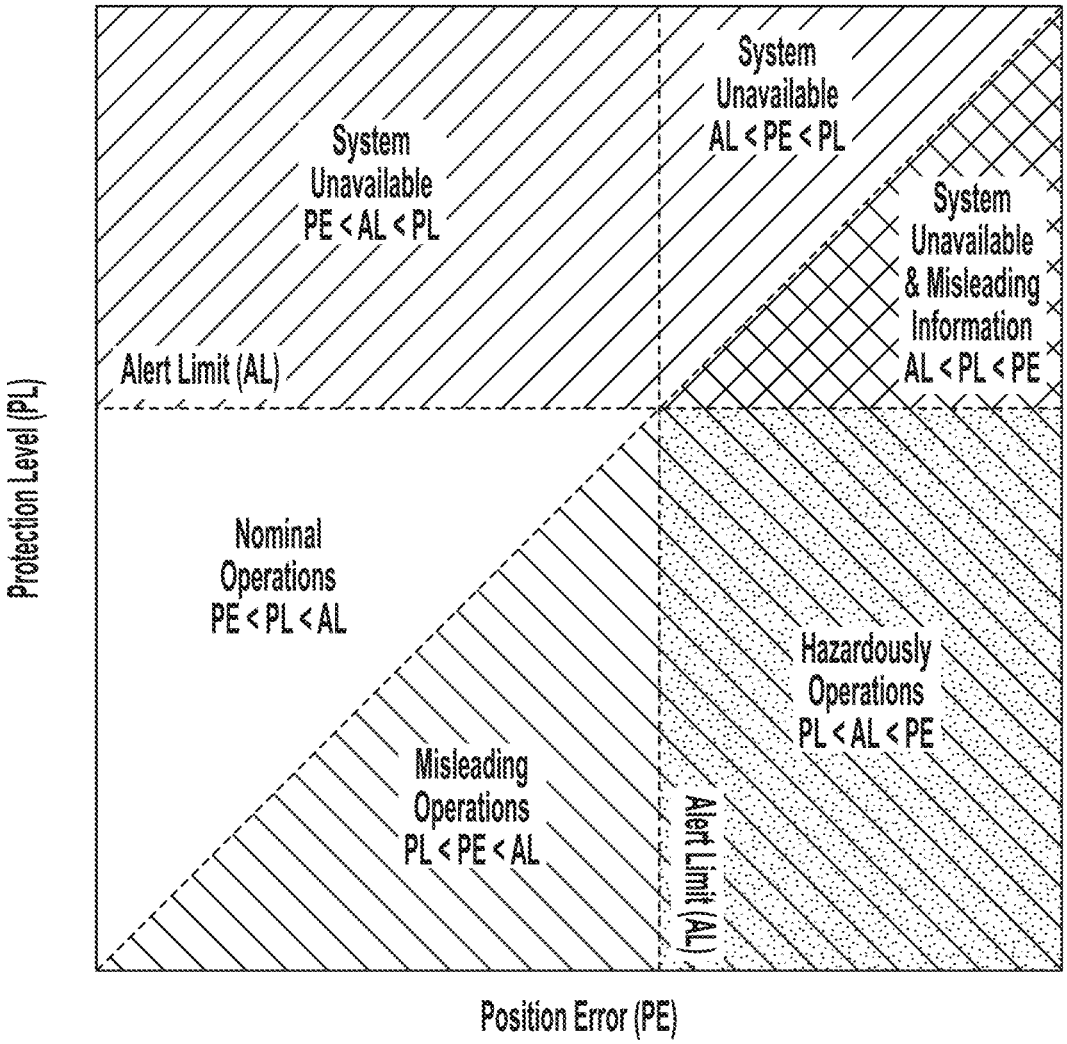
FIG. 14 is a graphical representation of a Standford diagram, in accordance with some embodiments.

In some embodiments, SIL-4 positioning in areas without beacon coverage is ensured by complementary measures such as supervision that dead reckoning positioning bias 512 in areas with beacon coverage is consistent and contained within a certain envelop such as ±5 m. Additionally or alternatively, safety bag 500 includes protection level supervision based on Standford diagrams (see FIG. 14). In some embodiments, a consistency check checks a calculated position against the previous position in consideration of the acceleration and speed. In some embodiments, optimization of the guideway beacon installation maximizes the beacon coverage areas with beacon coverage to provide tighter position uncertainty.

FIG. 6 is a pictorial diagram of platform beacon coverage in accordance with some embodiments. In some embodiments, a platform area 600 with beacons 602 installed in platform area 600 have the following dimensions: platform length of approximately 150 m, vehicle 601 length of approximately 150 m, a first set of beacons 602A installed 100 m (at each end of platform 600) outside of the platform edge, and a second set of beacons 602B installed 600 m further from first set 602A at each end of platform 600). Guideway beacons 602A, 602B, 602C and 602D (hereinafter referred to as guideway beacons 602), in some embodiments, are like guideway beacons 108, 208 and 308.

In some embodiments, the placement of guideway beacons 602A, 602B will yield 2000 m of beacon coverage area that coincides with guideway distances between platforms for metro/subway systems. Additionally or alternatively, beacon coverage area will yield 1100 m with guideway beacon coverage and 900 m without. In some embodiments, the non-coverage areas are no longer than 150 m.

In some embodiments, when a vehicle travels more than a certain distance (e.g., twice the average distance between platforms) without encountering any guideway beacon 602 then the vehicle's position will be determined to be unknown, an alarm will sound and reported to central control, and the vehicle's position will have to re-established (e.g., a cold start performed). In some embodiments, the maximum distance without observing any beacon must be long enough to at least reach the next platform. In some embodiments, several aspects must be considered to determine the maximum allowed distance without observing any beacon. For example, when vehicle 601 is moving from right to left approaching guideway beacon 602B and beacon 602B is not detected by both front vehicle beacons 603, the next opportunity to detect guideway beacon 602B is when the vehicle's rear passes beacon 602B. In some embodiments, when guideway beacon 602B is detected by at least 1 of the rear vehicle beacons 605 then the distance travelled without observing any guideway beacon is at least 450 m. In this example, guideway beacon 602B is most probably healthy and both front vehicle beacons have failed either intermittently or non-intermittently. This situation is expected to be rare as multiple beacon failure is uncommon. In some embodiments, when guideway beacon 602B is not detected by both rear vehicle beacons then the distance travelled without observing any guideway beacon is at least 750 m. In this example, guideway beacon 602B is most probably failed because at least four (4) vehicle beacons were not able to detect it.

In some embodiments, guideway beacons 602 are installed with redundancy, such as guideway beacons 602C, 602D. In some embodiments, the position and its associated position uncertainty, from the dead reckoning positioning algorithm ($P_{Dead\ Reckoning} \pm P_{Dead\ Reckoning\ Uncertainty}$) are compared with the positioning, and its associated uncertainty, determined by the speed and its associated uncertainty. In some embodiments, when the following conditions, in the equation below where V is vehicle speed, are satisfied the dead reckoning positioning is within high level of safety integrity (SIL-4).

$$\Sigma(V_{Non\text{-}Beacon} - V_{Non\text{-}Beacon\ Err}) \times \Delta t < P_{Dead\ Reckoning} - P_{Dead\ Reckoning\ Uncertainty} < P_{Dead\ Reckoning} < P_{Dead\ Reckoning} + P_{Dead\ Reckoning\ Uncertainty} < \Sigma(V_{Non\text{-}Beacon} + V_{Non\text{-}Beacon\ Err}) \times \Delta t$$

In some embodiments, in beacon coverage areas the speed is determined as solely based on beacons measurements with refresh rate of $Beacon_{refresh\ rate}$ (typically 5 Hz or higher) and referred to as $V_{Beacon}$. In some embodiments, $V_{Non\text{-}Beacon}$ is initialized while the vehicle is stationary and then once the speed is initialized solely based on the non-beacon speed algorithm. Additionally or alternatively, even though the beacons are available the beacons are not used to determine the non-beacon speed. In some embodiments, the non-beacon speed function is determined based on Radar and IMU, radar, tachometer/speed sensor and IMU, tachometer/speed sensor and single axis accelerometer or any other sensors arrangement that does not include localization capability as discussed above.

In some embodiments, the beacon speed ($V_{Beacon}$) and the non-beacon speed ($V_{Non\text{-}Beacon}$) are compared with the intent to assess the bias of the non-beacon speed. Additionally or alternatively, the assumption here is that the area covered with beacons is significant enough allowing proper calculation of the dead reckoning positioning bias. In some embodiments, in beacon coverage areas the beacon speed ($V_{Beacon}$) serves as a safety bag for the non-beacon speed ($V_{Non\text{-}Beacon}$). Additionally or alternatively, the safety bag provided by the beacon speed is greater than the uncertainty associated with the non-beacon speed.

In some embodiments, an amalgamation of the beacon speed and the non-beacon speed is preformed to remove the non-beacon speed bias (e.g., similar to the position bias discussed above) and estimate the speed uncertainty based on the summation of the beacon speed precision, the non-beacon speed precision and a certain margin. In some embodiments, the non-beacon speed bias, for a specified time interval, is the difference between the average speed determined based on the non-beacon speed function (e.g., using the beacons measurements for initialization only) and the average speed solely determined based on beacons measurements. Additionally or alternatively, the beacon speed is assumed to be the true (actual) value and the beacon speed precision is significantly smaller than the non-beacon speed precision (i.e. the beacon speed precision is less than or equal to 5 cm/sec ($\pm 3\sigma$)).

In some embodiments, in areas without beacons coverage the speed is determined solely based on the non-beacon speed function and referred to as $V_{Non\text{-}Beacon}$. In some embodiments, in areas without beacons coverage the beacon speed ($V_{Beacon}$) safety bag for the non-beacon speed ($V_{Non\text{-}Beacon}$) is not available. Therefore, the non-beacon speed bias is not determined. In some embodiments, the odometry algorithm use the last beacon measurements before a beacon coverage area is vacated to update the non-beacon speed. In some embodiments, the speed uncertainty is still determined in beacon coverage areas as the summation of the beacon speed precision (fixed value), the non-beacon speed precision and a certain margin. Additionally or alternatively, the non-beacon speed precision is determined based on error estimation techniques such as the covariance matrix of a Kalman Filter or equivalent.

In some embodiments, safety properties of the speed uncertainty in areas without beacon coverage is ensured by complementary measures such as determining that the non-beacon speed bias, in beacon coverage areas is consistent and contained within a certain envelop such as ±1 m/sec. Additionally or alternatively, consistency checks the calculated speed against the previous speed in consideration of the acceleration. In some embodiments, optimization of the beacon installation to maximize beacon coverage area with emphasis on areas where tighter speed uncertainty is needed. Additionally or alternatively, the beacon installation optimization is performed for both the positioning and odometry functions to find a solution that is good enough for both functions.

In some embodiments, in areas without beacon coverage the motion direction determined by the non-beacon speed function is checked for consistency with the motion direction previously determined in the beacon coverage area. Additionally or alternatively, the beacon coverage area motion direction is not expected to change as long as the vehicle is in motion and a stationary state is not determined.

Figure 7:
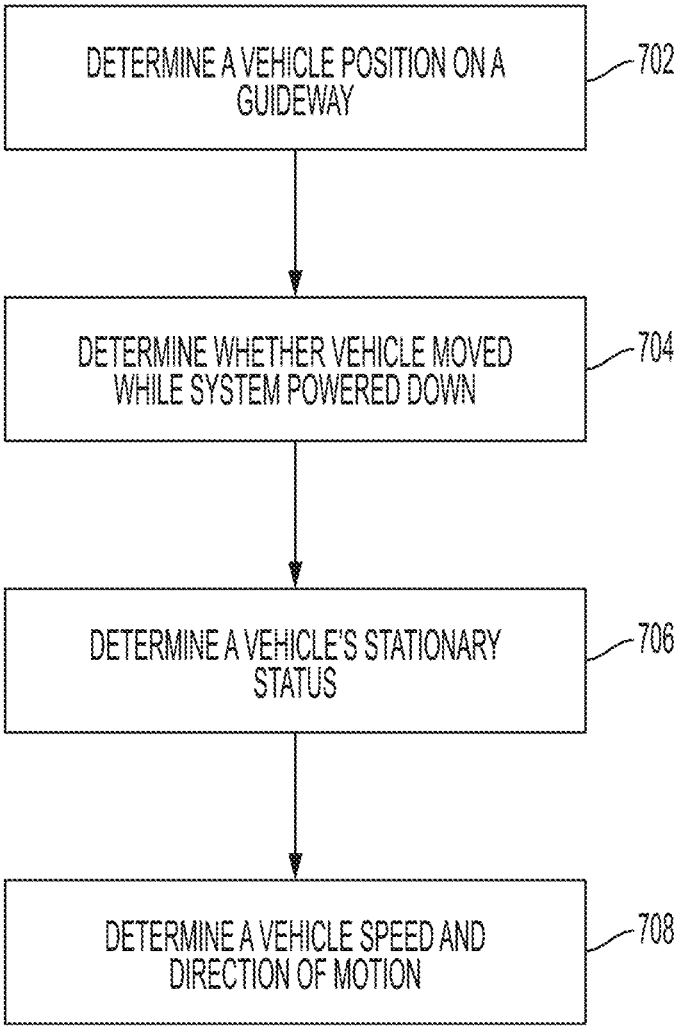
FIG. 7 is a high level flow diagram of a method for determining position and odometry, in accordance with some embodiments.

FIG. 7 is a high level flow diagram of a method for determining position and odometry in accordance with some embodiments. In some embodiments, the processing circuitry determines a vehicle position on a guideway using range measurements between the vehicle and the guideway beacons configured to communicate with one or more vehicle beacons installed on an end of a vehicle that are configured to communicate with one or more guideway beacons on a guideway (702). For instance, in a cold start condition, the processing circuitry determines whether the vehicle is positioned on the correct tracks.

In some embodiments, the processing circuitry determines, using range measurements between the vehicle and the guideway beacons after the processing circuitry wakes from a sleep state (e.g., a cold start), any change in the vehicle position from before the processing circuitry entered the sleep state (704). For instance, cold motion detection determines whether the vehicle moved while the processing circuitry was shutoff.

In some embodiments, the processing circuitry determines, using the range measurements between the vehicle and the guideway beacons, whether the vehicle is stationary (706). For instance, if the vehicle's speed is consistently less than 0.5 kph or accumulative displacement is less than 3 cm.

In some embodiments, the processing circuitry determines, using range measurements between the vehicle and the guideway beacons, a vehicle speed and a vehicle direction of motion on the guideway (708). For instance, speed is determined using a change in position over time. In some embodiments, a direction of motion is determined by using the range measurements to determine if vehicle motion is moving from a first end to a second end or a second end to a first end.

Figure 8:
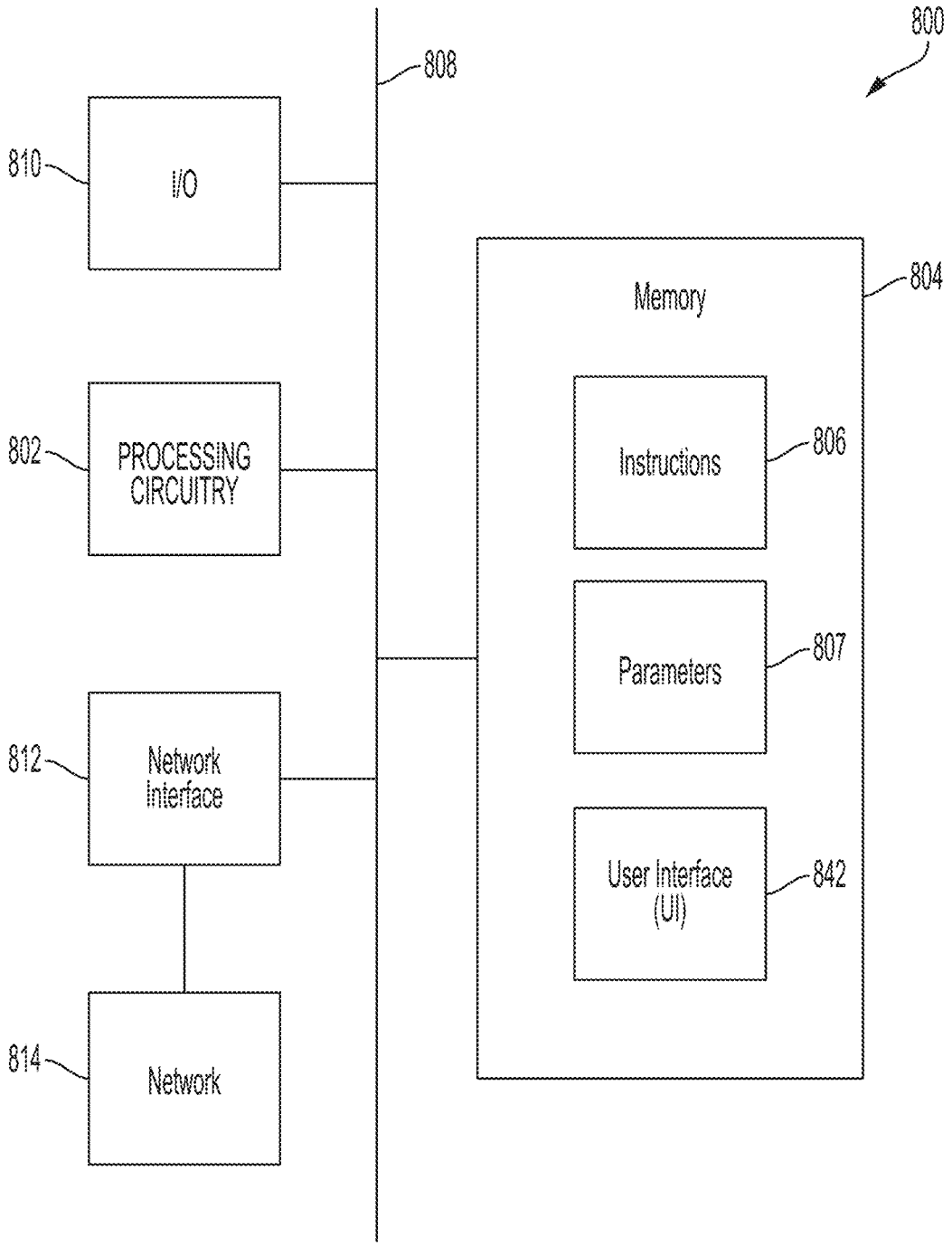
FIG. 8 is a high-level functional block diagram of a processor-based system, in accordance with some embodiments.

FIG. 8 is a high-level functional block diagram of a processor-based system 800, in accordance with some embodiments. In some embodiments, positioning and odometry system processing circuitry 800 is a general purpose computing device including a hardware processor 802 and a non-transitory, computer-readable storage medium 804. Storage medium 804, amongst other things, is encoded with, i.e., stores, computer program instructions 806, i.e., a set of executable instructions such as a positioning and odometry algorithm. Execution of instructions 806 by hardware processor 802 represents (at least in part) a positioning and odometry tool which implements a portion or all of the methods described herein in accordance with one or more embodiments (hereinafter, the noted processes and/or methods).

Processor 802 is electrically coupled to a computer-readable storage medium 804 via a bus 808. Processor 802 is also electrically coupled to an I/O interface 810 by bus 808. A network interface 812 is also electrically connected to processor 802 via bus 808. Network interface 812 is connected to a network 814, so that processor 802 and computer-readable storage medium 804 are capable of connecting to external elements via network 814. Processor 802 is configured to execute computer program instructions 806 encoded in computer-readable storage medium 804 in order to cause positioning and odometry processing circuitry 800 to be usable for performing a portion or all of the noted processes and/or methods. In one or more embodiments, processor 802 is a central processing unit (CPU), a multiprocessor, a distributed processing system, an application specific integrated circuit (ASIC), and/or a suitable processing unit.

In one or more embodiments, computer-readable storage medium 804 is an electronic, magnetic, optical, electromagnetic, infrared, and/or a semiconductor system (or apparatus or device). For example, computer-readable storage medium 804 includes a semiconductor or solid-state memory, a magnetic tape, a removable computer diskette, a random access memory (RAM), a read-only memory (ROM), a rigid magnetic disk, and/or an optical disk. In one or more embodiments using optical disks, computer-readable storage medium 804 includes a compact disk-read only memory (CD-ROM), a compact disk-read/write (CD-R/W), and/or a digital video disc (DVD).

In one or more embodiments, storage medium 804 stores computer program instructions 806 configured to cause positioning and odometry system processing circuitry 800 to be usable for performing a portion or all of the noted processes and/or methods. In one or more embodiments, storage medium 804 also stores information, such as positioning and odometry algorithm which facilitates performing a portion or all of the noted processes and/or methods. In one or more embodiments, storage medium 804 stores parameters 807.

Stationary resolution system processing circuitry 800 includes I/O interface 810. I/O interface 810 is coupled to external circuitry. In one or more embodiments, I/O interface 810 includes a keyboard, keypad, mouse, trackball, trackpad, touchscreen, and/or cursor direction keys for communicating information and commands to processor 802.

Stationary resolution system processing circuitry 800 also includes network interface 812 coupled to processor 802. Network interface 812 allows stationary resolution system processing circuitry 800 to communicate with network 814, to which one or more other computer systems are connected. Network interface 812 includes wireless network interfaces such as BLUETOOTH, WIFI, WIMAX, GPRS, or WCDMA; or wired network interfaces such as ETHERNET, USB, or IEEE-864. In one or more embodiments, a portion or all of noted processes and/or methods, is implemented in two or more stationary resolution system processing circuitries 800.

Positioning and odometry processing circuitry 800 is configured to receive information through I/O interface 810. The information received through I/O interface 810 includes one or more of instructions, data, design rules, and/or other parameters for processing by processor 802. The information is transferred to processor 802 via bus 808. Stationary resolution system processing circuitry 800 is configured to receive information related to a UI through I/O interface 810. The information is stored in computer-readable medium 804 as user interface (UI) 842.

In some embodiments, a portion or all of the noted processes and/or methods is implemented as a standalone software application for execution by a processor. In some embodiments, a portion or all of the noted processes and/or methods is implemented as a software application that is a part of an additional software application. In some embodiments, a portion or all of the noted processes and/or methods is implemented as a plug-in to a software application.

In some embodiments, the processes are realized as functions of a program stored in a non-transitory computer readable recording medium. Examples of a non-transitory computer-readable recording medium include, but are not limited to, external/removable and/or internal/built-in storage or memory unit, e.g., one or more of an optical disk, such as a DVD, a magnetic disk, such as a hard disk, a semiconductor memory, such as a ROM, a RAM, a memory card, and the like.

In some embodiments, a system of one or more computers are configured to perform particular operations or actions by virtue of having software, firmware, hardware, or a combination installed on the system that in operation causes or cause the system to perform the actions. One or more computer programs are configured to perform particular operations or actions by virtue of including instructions that, when executed by data processing apparatus, cause the apparatus to perform the actions. In some embodiments, a positioning and odometry system includes two or more vehicle beacons installed on an end of a vehicle and configured to communicate with one or more guideway beacons, the one or more guideway beacons installed along a guideway. The positioning and odometry system also includes processing circuitry configured to communicate with the one or more vehicle beacons, the processing circuitry configured to perform at least one of: determine, before the processing circuitry enters a sleep state, a first vehicle position on the guideway using range measurements between the vehicle beacons and the guideway beacons; determine, after the processing circuitry wakes from the sleep state, a second vehicle position on the guideway using range measurements between the vehicle beacons and the guideway beacons; determine, after the processing circuitry wakes from the sleep state, any difference between the first vehicle position on the guideway and the second vehicle position on the guideway; determine a third vehicle position on the guideway using range measurements between the vehicle and the guideway beacons taken at configurable time intervals; and determine a vehicle speed using range measurements between a single vehicle beacon and a single guideway beacon where speed is measured as a change in the third vehicle position over time. Other embodiments of this aspect include corresponding computer systems, apparatus, and computer programs recorded on one or more computer storage devices, each configured to perform the actions of the methods.

In some embodiments, implementations include one or more of the following features. The system where the processing circuitry is further configured to determine motion of the vehicle using range measurements between the vehicle beacons and the guideway beacons. The processing circuitry is further configured to determine a stationary state of the vehicle using range measurements between the vehicle beacons and the guideway beacons. The processing circuitry is further configured to determine dead-reckoning positioning of the vehicle in areas where the guideway beacons are not available. The system includes a speed sensor to determine vehicle speed in areas where the guideway beacons are not available. The processing circuitry is further configured to determine a vehicle direction of travel on the guideway based on a comparison of one or more past range measurements between the vehicle beacons and the guideway and a most recent one or more range measurements between the vehicle beacons and the guideway beacons. The processing circuitry is further configured to determine a vehicle speed uncertainty. The guideway is a first guideway and the processing circuitry is further configured to determine whether the vehicle is positioned on the first guideway or a second guideway. The predetermined time period for range measurements between the vehicle and the guideway beacons is between 10 msec and 175 msec. At least one of the one or more guideway beacons is a temporary installation. Implementations of the described techniques include hardware, a method or process, or computer software on a computer-accessible medium.

In some embodiments, a method includes determining, with processing circuitry configured to communicate with one or more vehicle beacons installed on an end of a vehicle and configured to communicate with one or more guideway beacons positioned at predetermined locations along a guideway, a vehicle position on the guideway using range measurements between the vehicle and the guideway beacons; determining, with the processing circuitry using the range measurements between the vehicle and the guideway beacons, a vehicle speed and a vehicle direction of motion on the guideway. The method also includes determining, with the processing circuitry using the range measurements between the vehicle and the guideway beacons, whether the vehicle is stationary. The method also includes determining, with the processing circuitry using range measurements between the vehicle and the guideway beacons after the processing circuitry wakes from a sleep state, vehicle movement on the guideway and determine a change in the vehicle position from before the processing circuitry entering the sleep state. Other embodiments of this aspect include corresponding computer systems, apparatus, and computer programs recorded on one or more computer storage devices, each configured to perform the actions of the methods.

In some embodiments, implementations include one or more of the following features. The method where the processing circuitry is a first processing circuitry, the method includes monitoring, with a second processing circuitry operatively coupled to the first processing circuitry, the first processing circuitry to prevent the processing circuitry from entering an unsafe state. The method includes determining, with the second processing circuitry, a safety bag for a dead reckoning positioning performed with the first processing circuitry. The method includes creating, with the second processing circuitry, a positioning uncertainty based on beacon positioning information from the first processing circuitry, dead reckoning positioning information from the first processing circuitry and a safety margin. The method includes issuing, with the second processing circuitry, an alarm when a difference between beacon positioning information and dead reckoning positioning information is outside bounds of an along guideways protection level. Implementations of the described techniques include hardware, a method or process, or computer software on a computer-accessible medium.

In some embodiments, a non-transitory computer-readable storage medium includes instructions to determine, with range measurements between one or more vehicle beacons installed on an end of a vehicle and configured to communicate with one or more guideway beacons positioned at predetermined locations along one or more guideways, after the processor wakes from a sleep state, vehicle position and guideway occupancy to determine a change in the vehicle position from before the processor entering the sleep state. The medium also includes instructions to determine, with the range measurements between the vehicle and the guideway beacons, a periodic vehicle position update. The medium also includes instructions to determine, with the range measurements between the vehicle and the guideway beacons, a vehicle speed and a vehicle direction of motion on the guideway. The medium also includes instructions to determine, with the range measurements between the vehicle and the guideway beacons, a vehicle stationary state. The medium also includes instructions to determine dead-reckoning positioning in guideway locations with no guideway beacons. The medium also includes instructions to determine the vehicle speed and the vehicle direction of motion in areas with no guideway beacons. Other embodiments of this aspect include corresponding computer systems, apparatus, and computer programs recorded on one or more computer storage devices, each configured to perform the actions of the methods.

In some embodiments, implementations include one or more of the following features. The storage medium includes executable instructions that, when executed by a processor, cause the processor to determine a non-beacon speed bias compensation and uncertainty estimation. The storage medium includes executable instructions that, when executed by a processor, cause the processor to monitor the dead-reckoning positioning to determine a position uncertainty. The storage medium includes executable instructions that, when executed by a processor, cause the processor to determine a vehicle speed uncertainty. Implementations of the described techniques include hardware, a method or process, or computer software on a computer-accessible medium.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A positioning and odometry system comprising:

two or more vehicle beacons installed on an end of a vehicle and configured to communicate with one or more guideway beacons, the one or more guideway beacons installed along a guideway;

processing circuitry configured to communicate with the one or more vehicle beacons, the processing circuitry configured to perform at least one of:

determine, before the processing circuitry enters a sleep state, a first vehicle position on the guideway using range measurements between the vehicle beacons and the guideway beacons;

determine, after the processing circuitry wakes from the sleep state, a second vehicle position on the guideway using range measurements between the vehicle beacons and the guideway beacons;

determine, after the processing circuitry wakes from the sleep state, any difference between the first vehicle position on the guideway and the second vehicle position on the guideway;

determine a third vehicle position on the guideway using range measurements between the vehicle and the guideway beacons taken at configurable time intervals; and determine a vehicle speed using range measurements between a single vehicle beacon and a single guideway beacon where speed is measured as a change in the third vehicle position over time.

2. The system of claim 1, wherein the processing circuitry is further configured to determine motion of the vehicle using range measurements between the vehicle beacons and the guideway beacons.

3. The system of claim 1, wherein the processing circuitry is further configured to determine a stationary state of the vehicle using range measurements between the vehicle beacons and the guideway beacons.

4. The system of claim 1, wherein the processing circuitry is further configured to determine dead-reckoning positioning of the vehicle in areas where the guideway beacons are not available.

5. The system of claim 1, further comprising a speed sensor to determine vehicle speed in areas where the guideway beacons are not available.

6. The system of claim 1, wherein the processing circuitry is further configured to determine a vehicle direction of travel on the guideway based on a comparison of one or more past range measurements between the vehicle beacons and the guideway beacons and a most recent one or more range measurements between the vehicle beacons and the guideway beacons.

7. The system of claim 6, wherein the processing circuitry is further configured to determine a vehicle speed uncertainty.

8. The system of claim 1, wherein the guideway is a first guideway and the processing circuitry is further configured to determine whether the vehicle is positioned on the first guideway or a second guideway.

9. The system of claim 1, wherein the configurable time intervals for range measurements between the vehicle and the guideway beacons is between 10 msec and 175 msec.

10. The system of claim 1, wherein at least one of the one or more guideway beacons is a temporary installation.

11. A method comprising:

determining, with processing circuitry configured to communicate with one or more vehicle beacons installed on an end of a vehicle configured to communicate with one or more guideway beacons positioned at predetermined locations along a guideway, a vehicle position on the guideway using range measurements between the vehicle and the guideway beacons;

determining, with the processing circuitry using range measurements between the vehicle and the guideway beacons after the processing circuitry wakes from a sleep state, vehicle movement on the guideway and determine a change in the vehicle position from before the processing circuitry entering the sleep state;

determining, with the processing circuitry using the range measurements between the vehicle and the guideway beacons, whether the vehicle is stationary; and determining, with the processing circuitry using the range measurements between the vehicle and the guideway beacons, a vehicle speed and a vehicle direction of motion on the guideway.

12. The method of claim 11 wherein the processing circuitry is a first processing circuitry, the method comprising monitoring, with a second processing circuitry operatively coupled to the first processing circuitry, the first processing circuitry to prevent the processing circuitry from entering an unsafe state.

13. The method of claim 12, further comprising determining, with the second processing circuitry, a safety bag for a dead reckoning positioning performed with the first processing circuitry.

14. The method of claim 13, further comprising creating, with the second processing circuitry, a positioning uncertainty based on beacon positioning information from the first processing circuitry, dead reckoning positioning information from the first processing circuitry and a safety margin.

15. The method of claim 14, further comprising issuing, with the second processing circuitry, an alarm when a difference between the beacon positioning information and the dead reckoning positioning information is outside bounds of an along guideways protection level.

16. A non-transitory computer-readable storage medium, comprising executable instructions that, when executed by a processor, cause the processor to:

determine, with range measurements between one or more vehicle beacons installed on an end of a vehicle and configured to communicate with one or more guideway beacons positioned at predetermined locations along one or more guideways, after the processor wakes from a sleep state, vehicle position and guideway occupancy to determine a change in the vehicle position from before the processor entering the sleep state;

determine, with the range measurements between the vehicle and the guideway beacons, a periodic vehicle position update;

determine, with the range measurements between the vehicle and the guideway beacons, a vehicle speed and a vehicle direction of motion on the guideway;

determine, with the range measurements between the vehicle and the guideway beacons, a vehicle stationary state;

determine dead-reckoning positioning; and determine dead-reckoning vehicle speed and dead reckoning vehicle direction of motion.

17. The storage medium of claim 16 further comprising executable instructions that, when executed by the processor, cause the processor to determine a non-beacon speed bias compensation and uncertainty estimation.

18. The storage medium of claim 16 further comprising executable instructions that, when executed by the processor, cause the processor to monitor the dead-reckoning positioning to determine a position uncertainty.

19. The storage medium of claim 18 further comprising executable instructions that, when executed by the processor, cause the processor to determine a vehicle speed uncertainty.

20. The storage medium of claim 16 further comprising executable instructions that, when executed by the processor, cause the processor to determine whether the vehicle is positioned on an incorrect guideway.

* * * * *